US011286069B2

(12) United States Patent
Campbell

(10) Patent No.: US 11,286,069 B2
(45) **Date of Patent: *Mar. 29, 2022**

(54) CROSS SEAL DEVICES FOR PACKAGE FORMING SYSTEMS AND RELATED METHODS

(71) Applicant: Automated Solutions, LLC, Sawmills, NC (US)

(72) Inventor: Robert L. Campbell, Hickory, NC (US)

(73) Assignee: Automated Solutions, LLC, Sawmills, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/939,327

(22) Filed: Jul. 27, 2020

(65) Prior Publication Data

US 2021/0009291 A1 Jan. 14, 2021

Related U.S. Application Data

(63) Continuation of application No. 15/684,910, filed on Aug. 23, 2017, now Pat. No. 10,723,493.

(Continued)

(51) Int. Cl.
*B65B 59/00* (2006.01)
*B65B 11/50* (2006.01)

(Continued)

(52) U.S. Cl.
CPC ..... *B65B 11/50* (2013.01); *B65B 9/02* (2013.01); *B65B 9/026* (2013.01); *B65B 25/14* (2013.01); *B65B 35/24* (2013.01); *B65B 41/16* (2013.01); *B65B 45/00* (2013.01); *B65B 51/30* (2013.01); *B65B 51/303* (2013.01); *B65B 57/00* (2013.01); *B65B 59/00* (2013.01); *B65B 59/001* (2019.05); *B65B 59/02* (2013.01); *B65B 61/06* (2013.01); *B65B 65/00* (2013.01); *B65B 2210/04* (2013.01)

(58) Field of Classification Search
CPC ..... B65B 11/50; B65B 9/02; B65B 41/16; B65B 45/00; B65B 51/00; B65B 51/10; B65B 51/30; B65B 51/26
USPC ..... 53/450, 476, 347.8, 375.8; 156/582, 156/583.1
See application file for complete search history.

(56) References Cited

U.S. PATENT DOCUMENTS 4,574,566 A * 3/1986 Eaves ..... B65B 9/067 53/450
5,444,964 A * 8/1995 Hanagata ..... B29C 65/7439 156/324

(Continued)

*Primary Examiner* — Chelsea E Stinson
(74) *Attorney, Agent, or Firm* — Michael Best & Friedrich LLP

(57) ABSTRACT

Cross Seal Devices and related methods are provided. A cross seal device for forming ends of packages being formed in a packaging forming system can include an anvil configured to extend transverse to a product pathway of a packaging forming system along which top and bottom sheet materials travel. The cross seal device can also include a track positioned above the anvil transverse to the product pathway. Further, the cross seal device can include a carriage configured to operate along the track. The carriage can include one or more rollers configured to engage the anvil to form a pressure contact between the anvil and the roller so that the top and bottom sheet materials are joined together.

20 Claims, 15 Drawing Sheets

Related U.S. Application Data

(60) Provisional application No. 62/378,432, filed on Aug. 23, 2016.

(51) Int. Cl.

| | |
|---|---|
| ***B65B 25/14*** | (2006.01) |
| ***B65B 9/02*** | (2006.01) |
| ***B65B 51/30*** | (2006.01) |
| ***B65B 59/02*** | (2006.01) |
| ***B65B 35/24*** | (2006.01) |
| ***B65B 41/16*** | (2006.01) |
| ***B65B 45/00*** | (2006.01) |
| ***B65B 57/00*** | (2006.01) |
| ***B65B 65/00*** | (2006.01) |
| ***B65B 61/06*** | (2006.01) |

(56) References Cited

U.S. PATENT DOCUMENTS

| | | | | |
|---|---|---|---|---|
| 5,941,048 | A * | 8/1999 | Spitler | H04N 1/4446 53/374.4 |
| 6,622,767 | B2 * | 9/2003 | Stork | B29C 65/18 156/522 |
| 10,723,493 | B2 * | 7/2020 | Campbell | B65B 25/14 |

* cited by examiner

CROSS SEAL DEVICES FOR PACKAGE FORMING SYSTEMS AND RELATED METHODS

RELATED APPLICATION

The presently disclosed subject matter is a continuation patent application of U.S. patent application Ser. No. 15/684,910, filed Aug. 23, 2017, which claims the benefit of U.S. Provisional Patent Application Ser. No. 62/378,432, filed Aug. 23, 2016, the disclosure of which is incorporated herein by reference in its entirety. U.S. patent application Ser. No. 15/684,887, filed Aug. 23, 2017, is also incorporated herein by reference in its entirety.

TECHNICAL FIELD

The present subject matter relates to shipping package forming apparatuses, systems, and related methods. In particular, the present subject matter relates to cross seal devices that aid in forming packages, such as envelopes, around physical items that are being shipped in the packages.

BACKGROUND

The advent of online purchasing, through such e-commerce website as Amazon or online box stores, such as Walmart online, have created a need for packaging items that are bought by a customer online and then shipped from a distribution center to the customer. These distribution centers must process thousands of items of various sizes.

These items include all of the various that are sold in mass on these e-commerce websites. Such items can include, but are not limited to: jewelry, such as rings, bracelets, necklaces, key rings, etc.; utility items, such as knives of various sizes, tools, etc.; electronics, such as cellular phones, tablet devices, televisions, computers, flash drives or other fobs, etc.; personal care items, such as make-up items, moisturizers and creams, razors, brushes, combs, hair dryers, etc.; apparel, such as dresses, pants, skirts, shorts, shirts, belts, shoes, socks, etc.; home furnishings, such as pillows, sheets, fabric coverings, etc.; toys of various sizes; and books of various sizes.

Due to the varied sizes of the items being processed in these distribution centers, packaging these items can be problematic. Having to separately package items can be labor intensive and time-consuming. Such problems can be partially addressed by separately items to be shipped from a fulfillment center by size. For smaller items, known as "smalls," such as books, jewelry, apparel, etc., envelope forming machines can be used to form envelope packages around the smaller items. These envelope forming machines allow placement of the smaller items between two sheets of material that for the envelope that will form the packing around the smaller item. The envelope forming machine can press and seal the sides and press, seal, and cut the ends to form the package around the smaller item.

While these envelope forming machines can speed up the packaging and shipping process, the current envelope forming machines still have many drawbacks is that cost processing time, can raise labor costs, and can hurt the quality of the packages being formed. For example, with current envelope forming machines, even slight variations in height of the items can misalign the sheets of material that can in turn cause weak seals along the sides of the package, and depending on the product used to form the sealed sides, can expose adhesives, sealants, or other tacky substances to so exterior of the package. Additionally, due to the mechanisms used to cut and seal the ends of the package, weakened seals are often formed leading to a tendency for one or both ends of the package to open unintentionally, for example, during shipping.

As such, a need exists, for example, for shipping package forming apparatuses and systems that can more effectively form packaging around a wider range of sizes of items to be shipped, while also providing sturdier packages that will not unintentionally open during shipping.

SUMMARY

The present subject matter provides package forming apparatuses, systems, and related methods. In particular, the present subject matter relates to apparatuses and systems that form and aid in forming packages, such as envelopes, around physical items that are being shipped in the packages. Methods related to the manufacture and use of the shipping package forming apparatuses and systems as disclosed herein are also provided.

Thus, it is an object of the presently disclosed subject matter to provide package forming apparatuses and systems as well as methods related thereto. While one or more objects of the presently disclosed subject matter having been stated hereinabove, and which is achieved in whole or in part by the presently disclosed subject matter, other objects will become evident as the description proceeds when taken in connection with the accompanying drawings as best described hereinbelow.

BRIEF DESCRIPTION OF THE DRAWINGS

A full and enabling disclosure of the present subject matter including the best mode thereof to one of ordinary skill in the art is set forth more particularly in the remainder of the specification, including reference to the accompanying figures, in which.

Figure 1A:
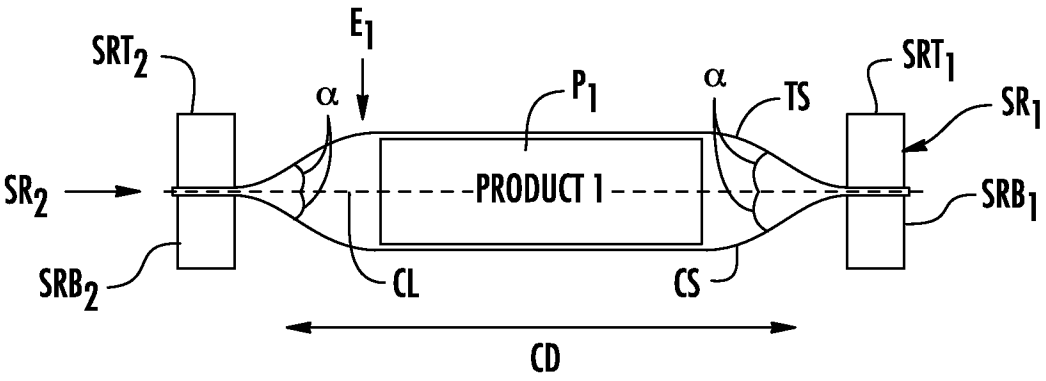
FIG. 1A illustrates a schematic view looking in a machine direction down a travel path of a product being packaged in an embodiment of a package forming system according to the present subject matter as a package is being formed around the product.

Repeat use of reference characters in the present specification and drawings is intended to represent the seam or analogous features or elements of the present subject matter.

DETAILED DESCRIPTION

Reference now will be made to the embodiments of the present subject matter, one or more examples of which are set forth below, Each example is provided by way of an explanation of the present subject matter, not as a limitation. In fact, it will be apparent to those skilled in the art that various modifications and variations can be made in the present subject matter without departing from the scope or spirit of the present subject matter. For instance, features illustrated or described as one embodiment can be used on another embodiment to yield still a further embodiment. It is to be understood by one of ordinary skill in the art that the present discussion is a description of exemplary embodiments only, and is not intended as limiting the broader aspects of the present subject matter, which broader aspects are embodied in exemplary constructions.

Although the terms first, second, right, left, front, back, top, bottom, etc. may be used herein to describe various features, elements, components, regions, layers and/or sections, these features, elements, components, regions, layers and/or sections should not be limited by these terms. These terms are only used to distinguish one feature, element, component, region, layer or section from another feature, element, component, region, layer or section. Thus, a first feature, element, component, region, layer or section discussed below could be termed a second feature, element, component, is region, layer or section without departing from the teachings of the disclosure herein.

Similarly, when a feature or element is being described in the present disclosure as "on" or "over" another feature or element, it is to be understood that the features or elements can either be directly contacting each other or have another feature or element between them, unless expressly stated to the contrary. Thus, these terms are simply describing the relative position of the features or elements to each other and do not necessarily mean "on top of" since the relative position above or below depends upon the orientation of the device to the viewer.

Embodiments, of the subject matter of the disclosure are described herein with reference to schematic illustrations of embodiments that may be idealized. As such, variations from the shapes and/or positions of features, elements or components within the illustrations as a result of, for example but not limited to, user preferences, manufacturing techniques and/or tolerances are expected. Shapes, sizes and/or positions of features, elements or components illustrated in the figures may also be magnified, minimized, exaggerated, shifted or simplified to facilitate explanation of the subject matter disclosed herein. Thus, the features, elements or components illustrated in the figures are schematic in nature and their shapes and/or positions are not intended to illustrate the precise configuration of the subject matter and are not necessarily intended to limit the scope of the subject matter disclosed herein unless it specifically stated otherwise herein.

It is to be understood that the ranges and limits mentioned herein include all ranges located within the prescribed limits (i.e., subranges). For instance, a range from about 100 to about 200 also includes ranges from 110 to 150, 170 to 190, 153 to 162, and 145.3 to 149.6. Further, a limit of up to about 7 also includes a limit of up to about 5, up to 3, and up to about 4.5, as well as ranges within the limit, such as from about 1 to about 5, and from about 3.2 to about 6.5.

The term "thermoplastic" is used herein to mean any material formed from a polymer which softens and flows when heated; such a polymer may be heated and softened a number of times without suffering any basic alteration in characteristics, provided heating is below the decomposition temperature of the polymer. Examples of thermoplastic polymers include, by way of illustration only, polyolefins, polyesters, polyamides, polyurethanes, acrylic ester polymers and copolymers, polyvinyl chloride, polyvinyl acetate, etc. and copolymers thereof.

"Cohesive" or "cohesives" as used herein means substances that can be applied to a substrate and once cured generally only bond or adhere to itself and not to other non-adhesive materials or substances. Thus, cohesives are substances that, once applied and cured, generally only adhere or bond together to form a seal when a portion of the cohesive come in contact with another portion of the cohesive and generally does not form a seal with other non-adhesive materials or substances with which the cohesive comes into contact. Cohesives, as used herein, are often referred to in the industry as self-seal, cold seal, or cold seal adhesives.

"Adhesive" or "adhesives" as used herein means substances that are used to secure materials, such as substrates, together by binding or adhering to the materials with which they come in contact and resist separation of the materials even under force.

Thus, adhesives are substances that have the ability to secure together non-similar materials or substances by binding and/or adhering to the non-similar materials or substances.

"Pressure-sensitive adhesives" as used herein means adhesives that can have binding or adhesion or enhanced binding or adhesion to non-similar materials or substances when placed under some level of pressure.

"Product" as used herein means one or more physical items that are being packaged on the package forming systems and apparatuses disclosed herein. The term "product" can include, but are not limited to such items as: jewelry, such as rings, bracelets, necklaces, key rings, etc.; utility items, such as knives of various sizes, tools, etc.; electronics, such as cellular phones, tablet devices, televisions, computers, flash drives or other fobs, etc.; personal care items, such as make-up items, moisturizers and creams, razors, brushes, combs, hair dryers, etc.; apparel, such as dresses, pants, skirts, shorts, shirts, belts, shoes, socks, etc.; home furnishings, such as pillows, sheets, fabric coverings, etc.; toys of various sizes; automobile and machinery parts, such as nuts, bolts, bushings, filters, bearings, etc.; tools and hardware, such as screws, nails, screwdrivers, wrenches, pliers, hammers, etc.; and books of various sizes. Thus, the term "product" as used herein can be synonymous and can be used interchangeably with the phrase "one or more products."

"Sheet material" as used herein means one or more items or materials are used to create packages and that can be packed or bundled together or processed in some manner to form a unit for transport.

The present subject matter discloses shipping package forming apparatuses, systems, and related methods. In particular, the present subject matter discloses apparatuses and systems that form and aid in forming packages, such as envelopes, around physical items that are being shipped in the packages. The presently disclosed shipping package forming apparatuses and systems have features that improve the forming of the package around items to be shipped. For example, in some embodiments, the shipping package forming apparatuses can ensure proper placement of the item relative to the sides of the package and can ensure proper alignment of the sides of the sheet material that form the sides of the package so that the sides of the package form a stronger seal. In some embodiments, the shipping package forming apparatuses can ensure proper searing of packages across the ends of the packages that for stronger seals at the ends of the formed packages. In some embodiments, a more efficient manner of cutting the sheet material to form the ends of the package can be provided.

Figure 1B:
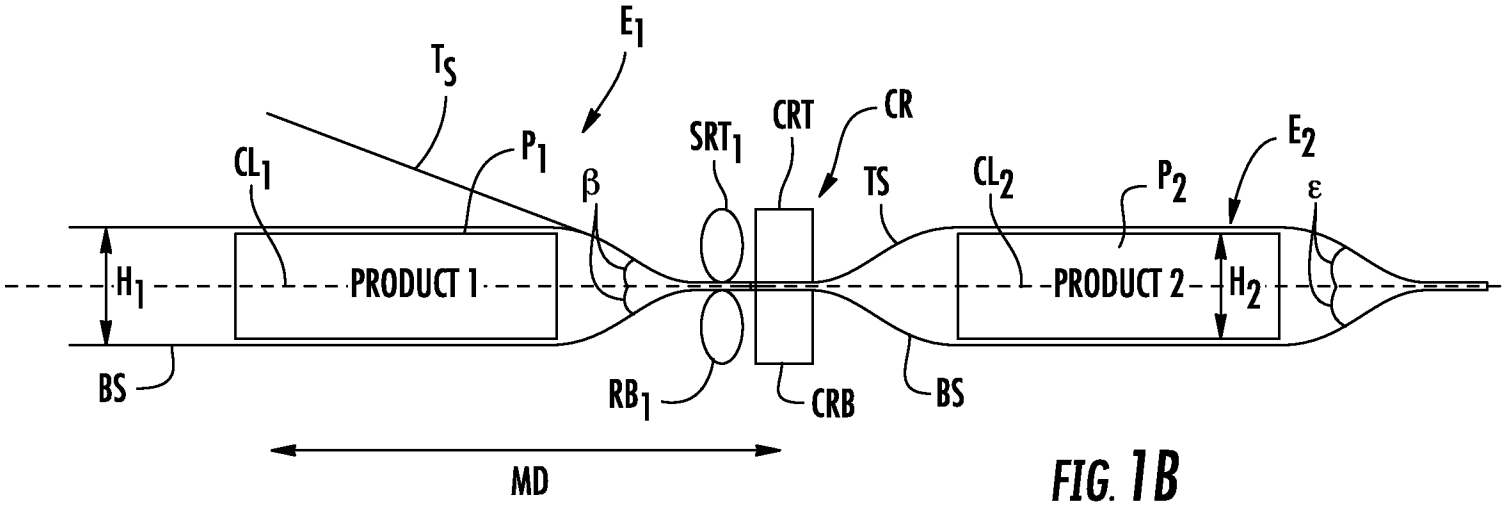
FIG. 1B illustrates a schematic view looking in a cross-machine direction perpendicular to a travel path of a product being packaged in an embodiment of a package forming system according to the present subject matter as a package is being formed around the product.

Referring to FIGS. 1A and 1B, schematics of packages $E_1$ and/or $E_2$ are shown being formed around products $P_1$ and/or $P_2$. The packages $E_1$ and/or $E_2$ are being formed by two sheets being pressed together along the sides as shown in FIG. 1A with packages $E_1$ and $E_2$ being pressed together at either end as shown in FIG. 1B. In particular, each of the packages $E_1$ and/or $E_2$ can be formed by a top sheet material TS and a bottom sheet material BS that can be pressed together by nip rollers as explained further below.

The top and bottom sheet materials TS, BS can be a variety of sheeting materials depending on the desired parameters of packaging. For example, in some embodiments, the top and bottom sheet materials TS, BS can comprise a suitable paper or other wood pulp product. In some embodiments, the top and bottom sheet materials TS, BS can comprise a paper with a cushioned backing secured thereto to for a cushioned interior of the packaging when the top and bottom sheet materials IS, BS are joined together. In some embodiments, the top and bottom sheet materials TS, BS can comprise a nonwoven fabric such as a spunbonded fabric, a meltblown fabric, or the like. In some embodiments, the top and bottom sheet materials TS, BS can comprise a polymeric film. For example, the top and bottom sheet materials TS, BS can comprise a thermoplastic film in some embodiments. The thermoplastic film can comprise a polyolefin film such as a polypropylene film, for instance. Alternatively, the thermoplastic film can comprise at least one of a polyethylene film, a nylon film, or a polyester film. In some embodiments, the top and bottom sheet materials TS, BS can comprise tri-layered films or other multi-layered films, such as nine-layered films.

In some embodiments, to join the top and bottom sheet materials TS, BS together, one or both of the top and bottom sheet materials TS, BS can have an adhesive on an interior side, such as pressure sensitive adhesives. In some embodiments, to join the top and bottom sheet materials TS, BS together, each of the top and bottom sheet materials TS, BS can have an interior side that includes cohesive layer. The cohesives that can be used to form the cohesive layer can have different bond strength depending on the desired parameters of the respective packaging sheet. For many applications, the cohesives that can be used, to form the cohesive layer can have a high bond strength. While, depending on the bond strength, cohesives can slightly tack or stick to other non-adhesive material, cohesives generally only provide a strong seal to themselves. When the cohesive layer coated on the top and bottom sheet materials TS, BS comes into contact with itself or the other sheet material coated with the same cohesive, the bond can result by applying appropriate pressure to the sheet materials with the contacted cohesives. Thus, through the use of the cohesive layer, the top and bottom sheet materials TS, BS can be bonded to, itself or to the other sheet material. In some embodiments, the cohesive can comprise a water-based cohesive. In some embodiments, the cohesive can comprise a solvent-based cohesive. Examples of cohesives that can be used to more or less affect include COSEAL™ and certain ROBOND™ CS, which are supplied by the Dow Chemical Company, and the cohesives used in CRO-NEL® and NYVEL® products, which are produced and sold by Automated Solutions, LLC, to name a few.

FIG. 1B is cross-sectional view taken in a cross-machine direction CD of the package $E_1$ being formed around the product $P_1$ showing the joining of the sides of the package $E_1$ being formed. Once a product $P_1$, which can include one or more items, is to be shipped, the product $P_1$ can be placed on the bottom sheet material BS within a package forming system or apparatus (not shown in FIGS. 1A and 1B). The bottom sheet material BS can act as a conveyor through the package forming system or apparatus. The top sheet material TS and the bottom sheet material BS can converge between the nips of two sets of rollers $SR_1$ and $SR_2$ on either side. The sets of rollers $SR_1$ and $SR_2$ can comprise pressurized or weighted rollers that can create a great enough pressure to bond the cohesives on the top and bottom sheet materials TS, BS that are facing each other. The first set of rollers $SR_1$ can include a top roller $SRT_1$ and a bottom roller $SRB_1$ on a first side. The second set of rollers $SR_2$ can include a top roller $SRT_2$ and a bottom roller $SRB_2$ on a second side. A first side of the top sheet material TS and a first side of the bottom sheet material BS converge together and run between the nip of the top roller $SRT_1$ and bottom roller $SRB_1$ to join the top sheet material TS and the bottom sheet material BS together on the first side. Similarly, a second side of the top sheet material TS and a second side of the bottom sheet material BS converge together and run between the nip of the top roller $SRT_2$ and bottom roller $SRB_2$ to join the top sheet material TS and the bottom sheet material BS together on the second side.

Ideally, it is desirable to have the product $P_1$ align with the sets of rollers $SR_1$ and $SR_2$ with the product $P_1$ so that a center line CL (shown in dashed lines) of the product $P_1$ can pass through, or proximal to the aligned nips of the sets of rollers SR1 and SR2. In this manner, the sides of the top and bottom sheet materials TS, BS can more closely align with each other to provide a better seal on the sides of the package. For example, it can be desirable to have the angles formed between the top sheet material TS and the centerline CL and between the bottom sheet material BS and the centerline CL to be the same or substantially similar.

Similarly, a set of rollers CR can be used to seal the ends of the packages $E_1$ and $E_2$ as the respective package is being formed as shown in FIG. 1B. The set of rollers CR can comprise pressurized or weighted rollers, that can create a great enough pressure to bond the cohesives on the top and bottom sheet materials TS, BS that are facing each other to form the ends of the respective packages $E_1$ and $E_2$. The set of rollers CR can run back and forward in the cross-machine direction as the product being packaged passes through the package forming system to form a first end and a second end of each package $E_1$ and $E_2$. The first set of rollers CR can include a top roller CRT and bottom roller CRB that run back and forth from one side of the forming apparatus to other across the pathway of the top and bottom sheet materials TS, BS. As shown in the schematic drawing of FIG. 1B, as the second package $E_2$ passes through the side rollers $SR_1$ such that an end of the product $P_2$ passes the side rollers $SR_1$ and enough of the top and bottom sheet materials TS, BS have passed through to allow a back end of the second package $E_2$ to be closed, the first set of rollers CR which can operate on a track can run across the package, or product, pathway with the top and bottom sheet materials TS, BS passing between the nip of set of rollers CR such that a seal is made between the top and bottom sheet materials TS, BS. This sealed portion between the top and bottom sheet materials TS, BS can form a second end of the second package $E_2$ as well as a first end of the first package $E_1$ being formed. In particular, the cross sealed portion can be cut or perforated by a cutting device to form the second end of the second package $E_2$ and the first end of the first package $E_1$ being formed. Such cuts or perforations can be performed after the end sealed portion is formed or during the formation of the end sealed portion. Similarly, instead of a set of rollers CR, a singular pressurized roller can form a nip with a portion of the shipping package forming system, such as an anvil bar or a portion of the frame, between which the top and bottom sheet materials TS, BS can pass as will be explained in more detail below.

As with the formation of the sides of the packages $E_1$ and $E_2$, the length of the top and bottom sheet materials TS, BS between the respective ends of the products $P_1$ and $P_2$ and the respective front end and the back end of the respective sides of the packages $E_1$ and $E_2$ is such that the front end and the back end of the respective sides of the packages $E_1$ and $E_2$ can at least proximately align with center lines $CL_1$ and $CL_2$ of the respective packages $E_1$ and $E_2$. In some embodiments, each of the ends of the packages $E_1$ and $E_2$ can be about an inch thick. With the alignment with the center lines $CL_1$ and $CL_2$ of the respective packages $E_1$ and $E_2$, the closure angles between the centerline and the top and bottom sheet materials TS, BS can be approximately the same. For example, the closure angle β between the top sheet material TS and the centerline $CL_1$ on an end of the package $E_1$ being formed can be equal to or substantially the same as the closure angle β between the bottom sheet material BS and the centerline $CL_1$ on the end of the package $E_1$ being formed. Similarly, the closure angle ε between the top sheet material TS and the centerline $CL_1$ on either end of the second package $E_2$ can be equal to or substantially the same as the closure angle ε between the bottom sheet material BS and the centerline $CL_1$ on either end of the second package $E_2$. As shown in FIGS. 1A and 1B, variations in the height of the product being shipped will likely often occur. As shown, product $P_2$ has a greater height than a height of the product $P_1$. Thus, to accommodate the alignment of the sealed side and end portions of the package with the centerline of the products, a portion of the shipping package forming system can be adjustable. For example, the shipping package forming system can have an adjustable table portion over which the bottom sheet material BS can run and on which the product (on top of the bottom sheet material BS) can be placed. Such a table portion can allow for the alignment of the nips between the various rollers (and, in some embodiments, between rollers and frame portion) to be aligned with a centerline line of each product to improve the sealing of the ends and sides of the respective packages.

Figure 2:
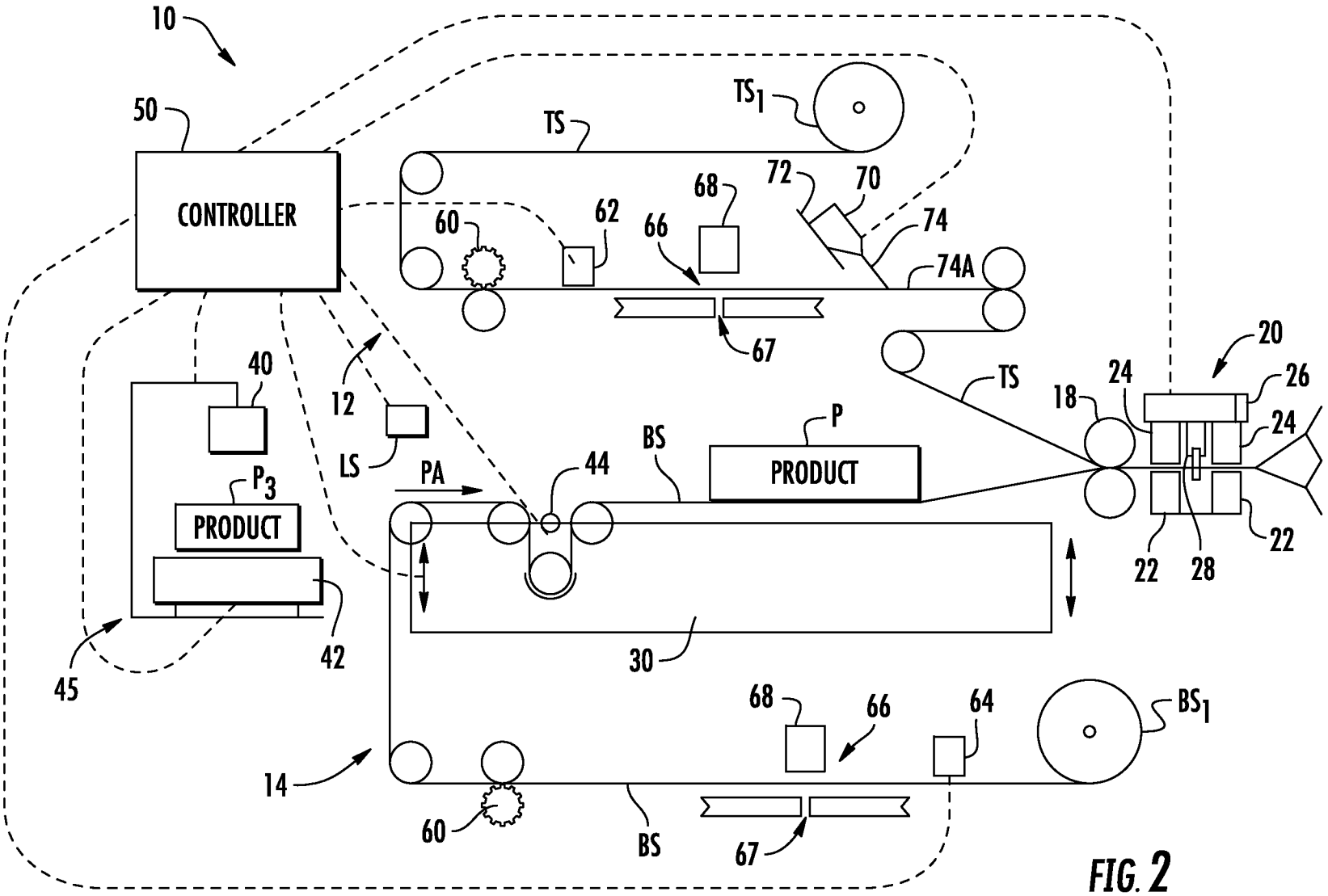
FIG. 2 illustrates a schematic view of an embodiment of a package forming system according to the present subject matter.

For example, referring to FIG. 2, a schematic of an embodiment of a shipping package forming system, also known as a former, generally designated 10, is provided. The package forming system 10 can comprise a top sheet material guide system 12 and a bottom sheet material guide system 14. Each of the top and bottom sheet material guide systems 12 and 14 can each comprise one or more tension rollers and drive rollers for providing top and bottom sheet materials TS, BS under tension. For example, a roll $TS_1$ of the top sheet material TS can be installed into the top sheet material guide system 12 and the top sheet material TS can be properly placed around the tension rollers and between the driver rollers. Similarly, a roll $BS_1$ of the bottom sheet material BS can be installed into the bottom sheet material guide system 14 and the bottom sheet material BS can be properly placed around the tension rollers and between the driver rollers. The sides of the top and bottom sheet materials TS, BS can be secured between the nips of two sets of rollers 18 (of which only one set is shown in FIG. 2, but similar to the sets of rollers $SR_1$ and $SR_2$ shown in FIG. 1A) on either side of a pathway of the top and bottom sheet materials TS, BS. The sets of rollers 18 can be pressurized or weighted to create a pressure high enough to seal the sides of the package being formed by the top and bottom sheet, materials TS, BS.

The package forming system 10 can also comprise a cross seal device 20 for forming ends of the package being formed. In the embodiment shown, the cross seal device 20 can comprise an anvil 22 that can be engaged by one or more rollers 24 carried by a carriage 26. The carriage 26 can be operated along a track (not shown) transverse to a product pathway PA along which a product being packaged travels and a pathway of the top and bottom sheet materials TS, BS. The rollers 24 can be placed under pressure so as to create a pressured engagement with anvil 22 as the rollers 24 roll across the top and bottom sheet materials TS, BS transverse to the pathway of the top and bottom sheet materials TS, BS. Due to cohesive on the interior side of the top and bottom sheet materials TS, BS, the top and bottom sheet materials TS, BS can be sealed together to form an end of package for the product as the rollers 24 roll over the top and bottom sheet materials TS, BS. When engaged with the anvil 22, the transverse movement of the rollers 24 can form a first end of a package being formed and a second end of the package being finished as the rollers 24 roll across the top and bottom sheet materials TS, BS. The carriage 26 can include one or more blades 28 that can cut the joined top and bottom sheet materials TS, BS to form the ends of the respective adjacent packages being formed in the system 10.

The package forming system 10 can also comprise a support table 30 that can be used to support a portion of the bottom sheet material BS and the product P that is placed upon the bottom sheet material BS and is being conveyed by the bottom sheet material BS. The support table 30 can include some of the guide system 14 of the bottom sheet material BS. The support table 30 can be automatically or semi-automatically adjusted upwardly or downwardly based on the centerline, of the product P being packaged to align the centerline of the product P with the nips of the sets of rollers 18 as well as the nip created by the roller 24 and anvil 22 when the rollers are put under pressure.

In some embodiments, the package forming system 10 can comprise a height sensor 40 that can measure the height of the product P being processed. Additionally, the package forming system 10 can comprise in some embodiments, a weight sensor 42, such, as a scale to measure the weight of the product or the package that is formed around the product and contains the product. For example, in some embodiments, a weight sensor can be positioned after the packaged is formed. Alternatively, the package that is formed around and that contains the product can be weighted in a later process. Further, in some embodiments, the package forming system 10 can include a sensor 44 that can measure the length of the product P.

As another example, in some embodiments, a weigh station 45 can be provided on which a product $P_3$ to be packaged can be placed before being placed on the conveying bottom sheet material BS on the support table 30. The weigh station 45 can include the scale 42 for measuring the weight of the product to be shipped. Above the scale 42, the height sensor 40 can be placed to measure the height of the product $P_3$ as the product $P_3$ is being weighed.

In some embodiments that include a sensor 44, the sensor 44 can operate as a length sensor and can be placed along the pathway PA of product within the package forming system 10 as the bottom sheet material BS moves the product P along the pathway. For example, in some embodiments, the sensor 44 can be secured to the support table 30 with guide rollers/tensioning rollers secured to the table 30 that guide the bottom sheet material BS around the sensor 44 in such a manner that the sensor 44 has an, unobstructed view of the product P as it passes above the sensor 44 while, at the same time, not interfering with the ability of the bottom sheet material BS to convey the product P within the package forming system 10.

Instead of using a height sensor and/or a length sensor, some embodiments can employ one or more sensors 44, such as photo eyes, that measure the distance the product moves after placement of the product by an operator on the bottom sheet material BS along the pathway of the package forming system 10. The controller 50 can use this measured distance to determine the length of top and bottom sheet materials TS and BS at the rear of the package and to determine the amount of adjustment that is needed for the table 30 for formation of the package.

As described above, when packaging a product with the package forming system 10, it is desirable to have the seal on the side of the package in the center of the package top to bottom. This makes the top and bottom sheet materials TS and BS the same width with both side edges equal. One method for determining the height or thickness of the product to be packaged is for an operator to examine the package and estimate its thickness. The adjustable table 30 can have a placement gate attached, as explained in more detail below, and a laser guide, or projector LS can project one or more laser lines onto the bottom sheet material BS on the table 30.

For example, the laser projector LS can project three (3) laser lines in front of the placement gate. The distance between the laser lines and the between the forward most laser line can comprise the placement gate the same distance or different distances. In some embodiments, these distances can be permanently set. In some embodiments, these distances can be varied depending on the types of products being packaged. For example, in some embodiments, these three lines can each be about one (1) inch apart and the first line closest to the placement gate can be about one (1) inch from the placement gate. The operator places the material to be packaged so that its front edge is located at the approximate thickness from the gate.

The laser lines being about one (1) inch apart give the operator an opportunity to place the products to be packaged in the appropriate place based on the operator's assessment of the thickness of the product or one or more products. Additionally, there can be a laser line projected down the center of the table 30 to assist the operator in placing the material in the middle of the table 30. The operator can then press a start button in communication with the controller 50 and the product is advanced on the bottom sheet material BS along the pathway of the package forming system 10. The distance the conveying bottom sheet material BS moves before the product to be packaged encounters the sensor 44, such as the view path of photo eyes, determines the height or thickness of the package estimated by the operator and the table can be automatically adjusted so that the center of the package is generally aligned with the center of the nip rollers 18 that seal the side of the package.

The distance between the sensor 44 and the cross seal device 20 that separate one package from the next package is a fixed distance that tells the controller 50 when to stop and cut the package in question. As the product continues to advance through the package forming system 10, the sensor 44 can identify the back edge of the package. To get the correct amount of top and bottom sheet materials TS, BS for the package to be formed, the controller 50 adds to the back of the package the same length of bottom sheet material BS as measured from the front of the product after the operator places it on the bottom sheet material BS along the pathway of the package forming system 10 to the position where the sensor 44 takes the reading of the front of the product. This represents the cut line for the back of the package and the front of the next product being packaged.

Also based on the measurement of the table 30 moves up and down to the center line of each of the products being packaged just before each package is about to advance through the side seal nip rollers. Using this method, the controller 50 does not need the height or the length of the product to determine the length of material needed for the package, but only the leading and trailing edges of the package.

The package forming system 10 can further comprise a controller 50 that can be in communication with drive system (not shown) that can power the package forming system 10 to control the operation of the package forming system 10. Further, for embodiments that employ one or more height, weight, and/or length sensors, such as sensors 40, 42, and 44, the controller 50 can be in communication with one or more of such sensors 40, 42, 44. The controller 50 can also be in communication with the driver system (not shown) that can be used to adjust the support table 30 upwardly or downwardly. The controller 50 can comprise any capable processing unit, such as a programmable logic controller ("PLC"), a desktop computer, a laptop computer, a mini computer, or the like, including combinations thereof. The controller 50 can process the information provided by the sensors mentioned above as well as other sensors and information that the controller 50 can use to effectively operate the package forming system 10.

Regarding the adjustment of the table 30, the controller 50 can obtain and process information from the sensors, such as height sensor 40 or measurements from the sensor 44, to determine whether the table 30 should be moved upward or downward to position the table 30 such that the centerline of the product aligns properly with the nips of the set of side rollers 18 and the roller 24 and the anvil 22. The controller 50 can then communicate with a drive system (not shown) that moves the table 30 up and down to move the table 30 to the desired position at the appropriate time once the product that was measured is placed on the bottom sheet material BS and the table 30.

Figure 3A:
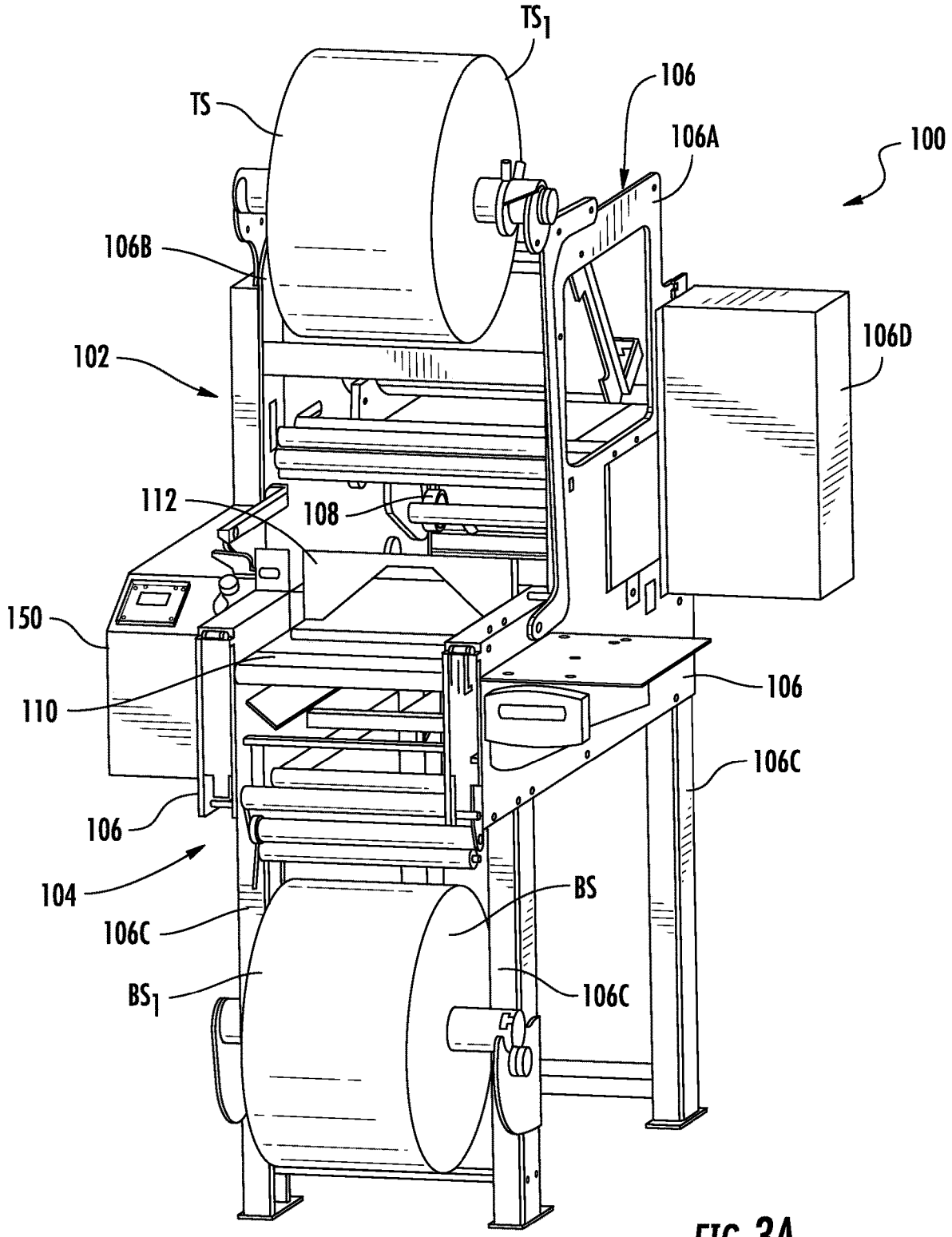
FIG. 3A illustrates a front top perspective view of another embodiment of a package forming system according to the present subject matter.
Figure 3B:
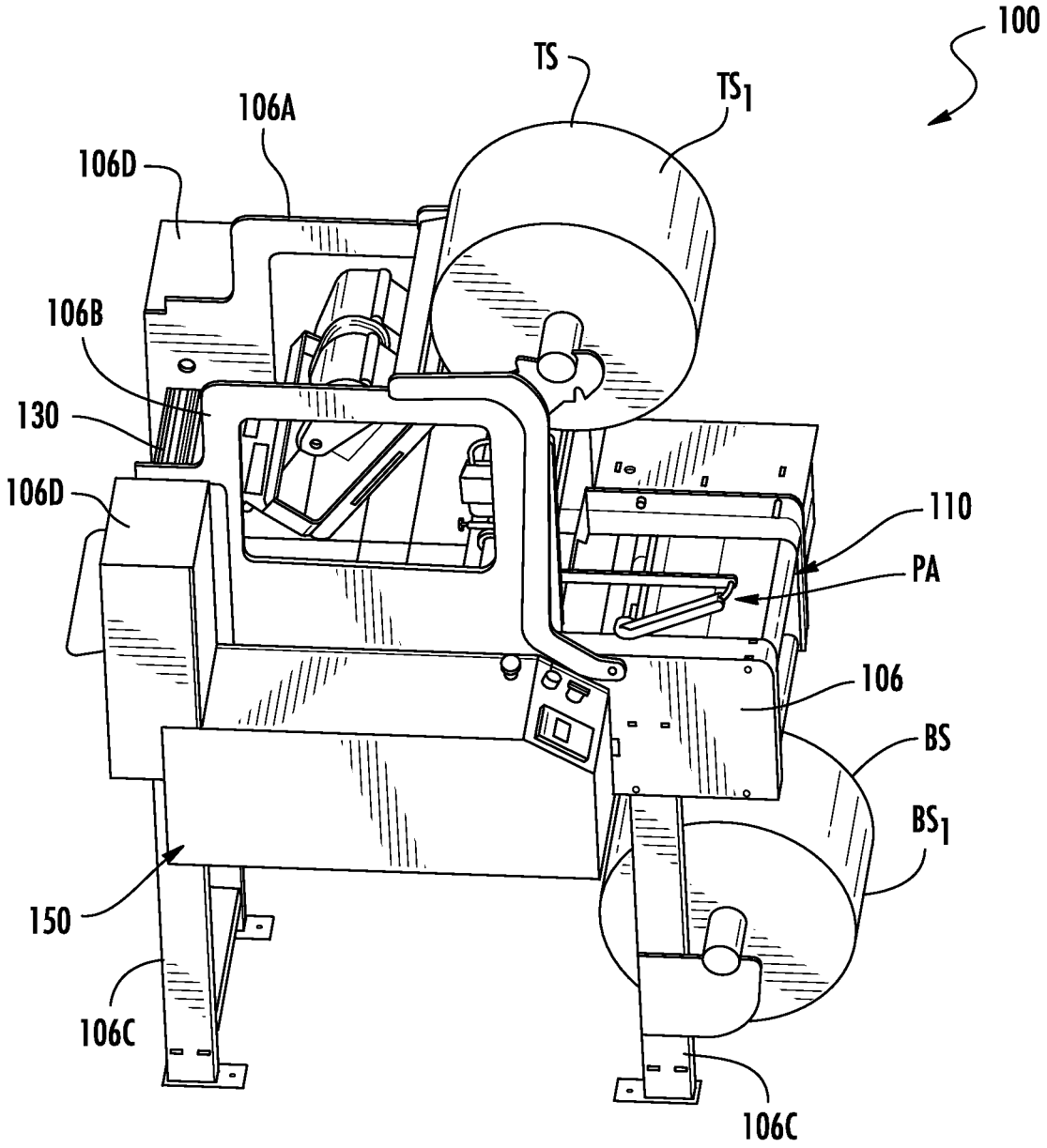
FIG. 3B illustrates a side top perspective view of the embodiment of the package forming system according to FIG. 3A.
Figure 3C:
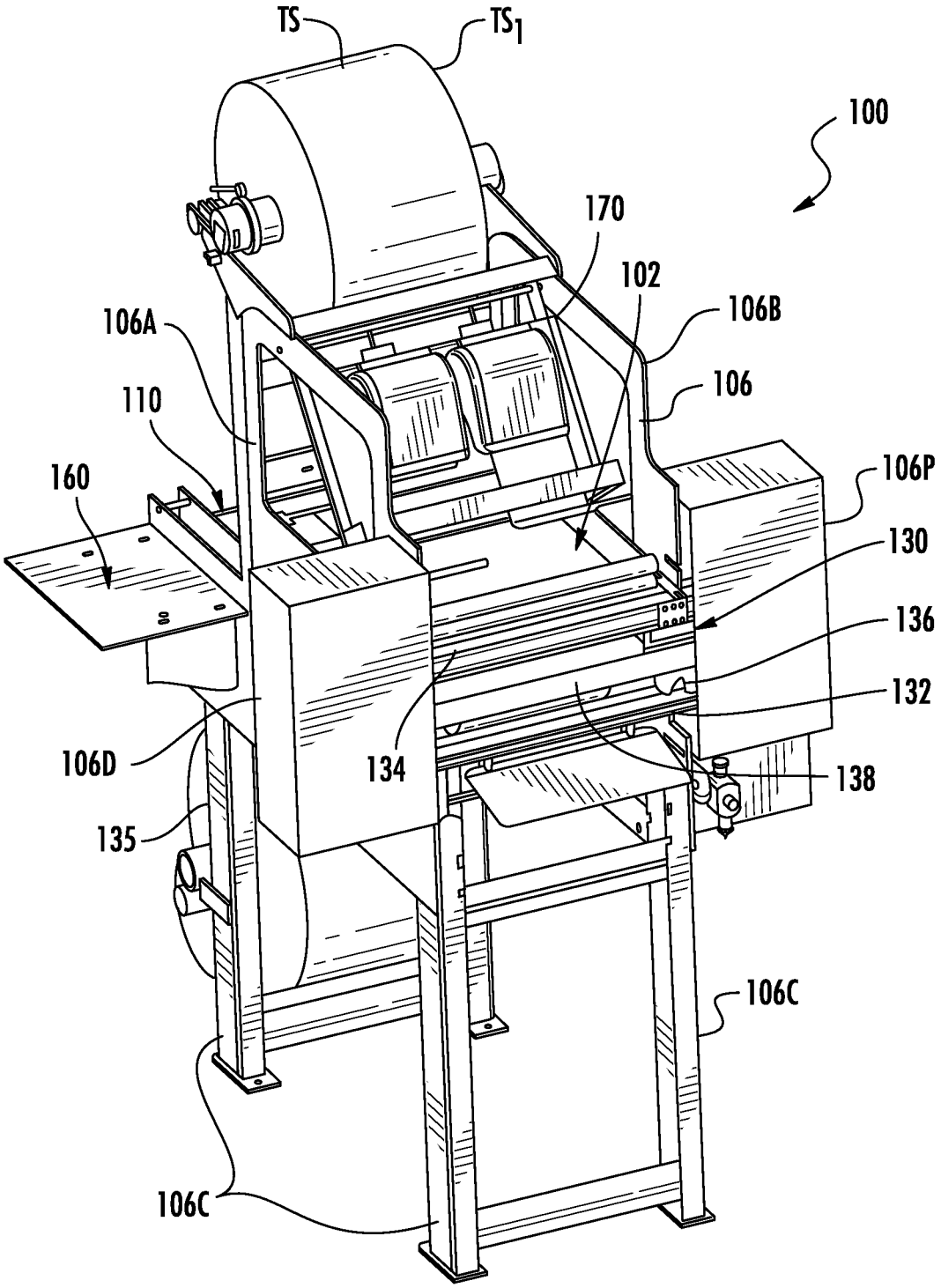
FIG. 3C illustrates a rear top perspective view of the embodiment of the package forming system according to FIG. 3A.

Referring to FIGS. 3A-3C and 4A-4H, an embodiment of a package forming system, also known as a former, generally designated 100, is provided. As shown in FIGS. 3A-3C, the package forming system 100 can comprise a top sheet material guide system 102 and a bottom sheet material guide system 104 that can support top and bottom sheet material rolls $TS_1$, $BS_1$ feed top and bottom sheet materials TS, BS into the package forming system 100 to form packaging around a product. The package forming system 100 can also comprise a frame 106 for supporting the sheet material guide systems 102, 104 and other components of the package forming system 100, including an adjustable support table 110. The support table 110 of the package forming system 100 can be used to support a portion of the bottom sheet material BS and the product that is placed upon the bottom sheet material BS and is being conveyed by the bottom sheet material BS. The frame 106 can comprise outer frame side panels 106A, 106B as well as a plurality of legs 106C that can be directly or indirectly secured to the side panels 106A, 106B. In some embodiments, the frame 106 can also comprise one or more safety guards 106D that can cover components of the package forming system 100 to protect the respective components of the package forming system 100 and reduce the possibility of injury to an operator of the package forming system 100.

The package forming system 100 can also comprise two sets of nip rollers 108 on either side of a product pathway PA along which the product travels to seal the sides of a package being formed and a cross seal device 130 that can be used to seal the ends of the packages being formed in the system 100 and thereby forming ends of the package being formed. The package forming system 100 can further comprise a controller 150 that can be used to control the operation of the package forming system 100 and the different systems, components, and devices that comprise the package forming system 100, including the adjustment of the adjustable table 110, the nip rollers 108 and cross seal device 130. In particular, the controller 150 can also operate the cross seal device 130 to form and seal the ends of the packages around the respective products being packaged as explained in more detail below.

In the embodiment shown, the cross seal device 130 can comprise an anvil 132 that can be engaged by one or more rollers 142 carried by a carriage 136. The carriage 136 can comprise a top wall 136A and first and second carriage walls 136B, 136C. The carriage 136 can be operated along a track 134 transverse to the pathway of the top and bottom sheet materials TS, BS. The carriage top wall 136A can have rails that engage the track 134.

The anvil 132 can comprise a blade slot 132A therein in which the first and second blades 144A and 144B can run once the roller carriage 136 engages the anvil 132 and the carriage 136 runs across the anvil 132. In some embodiments, the blade slot 132A can have a singular width. In some embodiments, the blade slot 132A can have varying widths. For example, as shown in FIG. 60, the blade slot 132A may have a wider width $132A_1$ on the ends where the blades rotate, while the middle portion of the slot 132A is more narrow where the cutting of the sheet materials TS and BS occurs. Thus, in some embodiments, the width of the middle portion of the slot 132A can generally correspond to the width of the sheet materials TS and BS, Such a slotted anvil 132 can be used with sheet material made of a polymeric film of the like to provide a cleaner cut and prevent clogging of the slot 132A.

The cross seal device 130 can also comprise safety bars 138 that, move downward around the carriage 136 to the anvil 132 to block access to the carriage 136 when roller 142 engages the anvil 132. Both ends of the safety bars 138 can be equipped with sensors that can detect if either of the ends of the respective safety bars 138 is completely lowered so that only the top and bottom sheet materials TS, BS are between the safety bars 138 and the anvil 132. For example, the sensors on the ends of the safety bars 138 can comprise switches that change state when the ends of the safety bars 138 have moved far enough downward and the anvil 132 has moved far enough upward to indicate that only the top and bottom sheet materials TS, BS are between the safety bars 138 and the anvil 132. The rollers 142 can be placed under pressure so as to create a pressured engagement with anvil 132 as the rollers 142 roll across the top and bottom sheet materials TS, BS transverse to the pathway PA of the top and bottom sheet materials TS, BS. Due to cohesive on the interior side of the top and bottom sheet materials TS, BS, the top and bottom sheet materials TS, BS can be sealed together to form an end, of package for the product as the rollers 142 roll over the top and bottom sheet materials TS, BS. When engaged with the anvil 132, the transverse movement of the rollers 142 can roll across the top and bottom sheet materials TS, BS to form a first end of a second package being formed and a second end of a first package being finished that is ahead of the second package. The acute pressure of the roller 142 against the anvil can create a strong seal between the top and bottom sheet materials TS, BS. The carriage 136 can include blades 144A and 144B that can cut the joined top and bottom sheet materials TS, BS to form the ends of the respective adjacent packages being formed in the system 100.

The first blade 144A can be secured to the carriage 136 by a pivot fulcrum 146A. The pivot fulcrum 146A can be secured to first carriage wall 136B and second carriage wall 136C of the carriage 136 so that the first blade 144A is secured on one side of the rollers 142. The second blade 144B can be secured to the carriage 136 by a pivot fulcrum 146B. The pivot fulcrum 146B can be secured to first carriage wall 136B and second carriage wall 136C of the carriage 136 so that the second blade 144B is secured on opposite sides of the rollers 142. Also secured between the first carriage wall 136B and second carriage wall 136C can be first and second stops 148A and 148B. The first stop 148A can be on the opposite side of the first blade 144A from the roller 142. The second stop 148B can be on the opposite side of the second blade 144B from the roller 142. Depending on the direction that the carriage 136 is moving along the track 134, the first blade 144A can pivot, about the first pivot fulcrum 146A toward the first stop 148A while the second blade 144B can pivot about the second pivot fulcrum 146B toward the roller 142 or the first blade 144A can pivot about the first pivot fulcrum 146A toward the roller 142 while the second blade 144B can pivot about the second pivot fulcrum 146B toward second stop 148B as will be explained further below. The carriage 136 that seals the ends of the packages can move along the track 134 either right to left or left to right.

When the carriage 136 is on the right side of the pathway PA in which the top and bottom sheet materials TS, BS travels, the first blade 144A has a noncutting side facing the top and bottom sheet materials TS, BS while the second blade 144B has a cutting side, which can be, for example, a razor blade, that faces the top and bottom sheet materials TS, BS. When the carriage 136 travels from right to left in the direction $A_1$ transverse to the pathway PA in which the top and bottom sheet materials TS, BS travels, the noncutting side of the first blade 144A contacts the side of the top and bottom sheet materials TS, BS so that the first blade 144A rotates in a direction. $D_1$ upward out of the slot 132A of the anvil 1321 toward the roller 142. Meanwhile, as the carriage 136 travels in the direction $A_1$, the cutting side of the second blade 144B contacts the side of the top and bottom sheet materials TS, BS so that the second blade 144B rotates about the pivot fulcrum 1466 in a direction $D_3$ toward the second stops 148B where the second stop 148B stops the second blade 144B so that the cutting side is held at a position to cut the top and bottom sheet materials TS, BS.

Conversely, when the carriage 136 is on the left side of the pathway PA in which the top and bottom sheet materials TS, BS travel, the second blade 144B has a noncutting side facing the top and bottom sheet materials TS, BS while the first blade 144A has a cutting side, which can be, for example, a razor blade, that faces the top and bottom sheet materials TS, BS. When the carriage 136 travels from left to right in the direction $B_1$ transverse to the pathway PA in which the top and bottom sheet materials TS, BS travels, the noncutting side of the second blade 144B contacts the side of the top and bottom sheet materials TS, BS so that the second blade 144B rotates about the second pivot fulcrum 146A in direction $D_4$ upward out of the slot 132A of the anvil 132 toward the roller 142. Meanwhile, as the carriage 136 travels in the direction $B_1$, the cutting side of the first blade 144A contacts the side of the top and bottom sheet materials TS, BS so that the first blade 144A rotates about the first pivot fulcrum 146A in direction $D_2$ toward the first stops 148A where the stop 148A stops the first blade 144A so that the cutting side is held at a position to cut the top and bottom sheet materials TS, BS.

The roller 142 can be held within the carriage 136 by an axle 142C that allows for rotation of the roller 142. In some embodiments, the roller 142 can comprise a roller with a groove around a circumference of the roller 142. In some embodiments, the roller 142 can comprise two rollers that are positioned side by side. In some embodiments of the carriage 136, the first and second blades 144A and 144B can be aligned with the roller 142 such that when the first and second blades 144A and 144B are pivoted in the respective directions $D_1$ and $D_3$, the first and second blades 144A and 144B can be pushed toward the groove in such embodiments where the roller 142 has a groove around the circumference of the roller 142 or can be pushed toward a gap between the rollers in such embodiments where the roller 142 comprises two side-by-side rollers.

In some embodiments, the carriage 136 can be longer in length to allow the blades 144A, 144B to rotate upward without contacting the roller 142, entering a groove in the roller 142 or, in embodiments where two side-by-side rollers are used, entering a gap between the two side-by-side rollers of the roller 142. In such embodiments with a longer carriage 136, the travel path of the carriage 136 can be longer. For instance, in some such embodiments, the track 134 and the anvil 132 of the cross seal device 130 can each have a longer length to accommodate the longer carriage 136. In this manner, room can be created for the longer carriage 136 as it travels back and forth across the cross direction of the pathway PA of the sheet material and products being packaged and comes to a resting position on either side of the pathway PA.

To form the pressure contact between the anvil 132 and the roller 142 that seal the ends of the packages being formed, the cross seal device 130 can comprise one or more pressure application devices. Such pressure application devices can include, but are not limited to rotatable cam device, springs, compressed air cylinders, hydraulic cylinders, or the like. For example, in some embodiments, as shown in FIGS. 3A-3C and 4A-4D, the cross seal device can comprise a plurality of compressed air cylinders 140A, 140B that can create the pressure contact between the anvil 132 and the roller 142. For instance, in some embodiments, the compressed air cylinders 140A, 140B can be secured to the anvil 132 to raise and lower the anvil 132 toward the roller 142 to create the pressure contact between the anvil 132 and the roller 142. The use of the roller 142 in pressure contact with the anvil 132 creates a better seal because it can create an acute pressure contact point between the anvil and surface of the roller 142 tangential to the surface of the anvil 132 that is much greater than a much larger contact surface, such as the contact surface that can be created by a long bar running the length of the anvil, that is created with the same pressure force. While a long sealing bar can create a seal across the package to form an end, the roller 142 can create a stronger seal at the ends of the package due to the acute pressure contact point created between the anvil and surface of the roller 142 tangential to the surface of the anvil 132.

In some embodiments, compressed air cylinders 140C, 140D can be secured to the safety bars 138 to raise and lower the safety bars 138 toward the anvil 132 to determine if there is an obstruction along the path of travel of the roller 142 before the carriage 136 is moved along the track 134. For example, in some embodiments, a sensor can be provided to make sure that the safety bars 138 makes contact with the anvil 132 along the anvil 138 before the carriage 136 can be activated to move along the track 134. If an obstruction occurs preventing the safety bars 138 from evenly contacting the anvil 132 and the switch from being made, for example, a hand of an operator being between the anvil 132 and the safety bars 138, then, the carriage 136 can be disabled until the obstruction is removed and the safety bars 138 evenly contacts the anvil 132 and the switch is made. Thereby, injury to an operator and/or the cross seal device 130 by the pressure contact between the anvil 132 and the roller 142 can be prevented.

During operation, the carriage 136 can reside on either side of the top and bottom sheet materials TS, BS as a package that is being formed passes after the roller 142 and anvil 132 have formed the initial first end. In some embodiments, the anvil 132 can be moved downward to provide clearance for the items being package to pass by along the pathway PA. In some embodiments, the safety bars 138 can be moved upward to provide clearance for the items being package to pass by along the pathway w PA. In some embodiments, both the anvil 132 can be moved downward and the safety bars 138 can be moved upward to provide clearance for the items being package to pass by along the pathway PA. In the embodiment shown, the cylinders 140A, 140B can move the anvil 132 downward, while the cylinders 140C, 140D can move the safety bars 138 upward. For example, in some embodiments, the cylinders 140A, 140B can move the anvil 132 downward between about 0.5 inches and about 4 inches. In some embodiments, the cylinders 140A, 140B can move the anvil 132 downward between about 1 inch and about 3 inches. In some embodiments, the cylinders 140A, 140B can move the anvil 132 downward about 2 inches. Similarly, in some embodiments, the cylinders 140C, 140D can move the safety bars 138 upward between about 0.5 inches and about 4 inches. In some embodiments, the cylinders 140C, 140D can move the safety bars 138 upward between about 1 inch and about 3 inches. In some embodiments, the cylinders 140C, 140D can move the safety bars 138 upward about 2 inches.

Due to the hardness of the rollers and the amount of pressure needed between the anvil 132 and the roller 142 needed to create a good seal on the ends of the package, the safety bars 138 can have a tough time making even contact across the anvil since the cylinder 140A or 1408 on the side opposite where the carriage 136 resides can be pulled further upward when under force by the respective cylinder 140A or 140B so that the anvil 132 exact at a slight angle as compared to the safety bars 138. When the anvil 132 is at an angle to the safety bars 138 the contact switch can, in some instances, not be properly made so as to activate the carriage 136 and track 134. To combat this problem, the anvil can have earn surfaces 132$B_1$ and 132$B_2$ on either side of the anvil 132 where the rollers 142 reside when the carriage 136 is at rest on either side of the pathway PA as show in FIGS. 4G and 4H. The cam surfaces 132$B_1$ and 132$B_2$ can comprise slight indentions. The depth of the indentions can be such that the anvil 132 can be about parallel with the safety bars 138 when the safety bars 138 are in a down contact position so that the contact switch can be made. Once the contact switch is made, the carriage 136 can be activated to move in the proper transverse direction to the pathway PA to form the ends of the respective packages with the rollers riding up the respective cam surface 132$B_1$, 132$B_2$. In such embodiments, the carriage 136 can hold its position relative to the track 134 as it travels along the track 134 such that the roller 142 pushes the anvil 132 downward as the roller 142 moves out from the respective cam surfaces 132$B_1$, 132$B_2$ and along the top of the anvil 132.

Figure 4A:
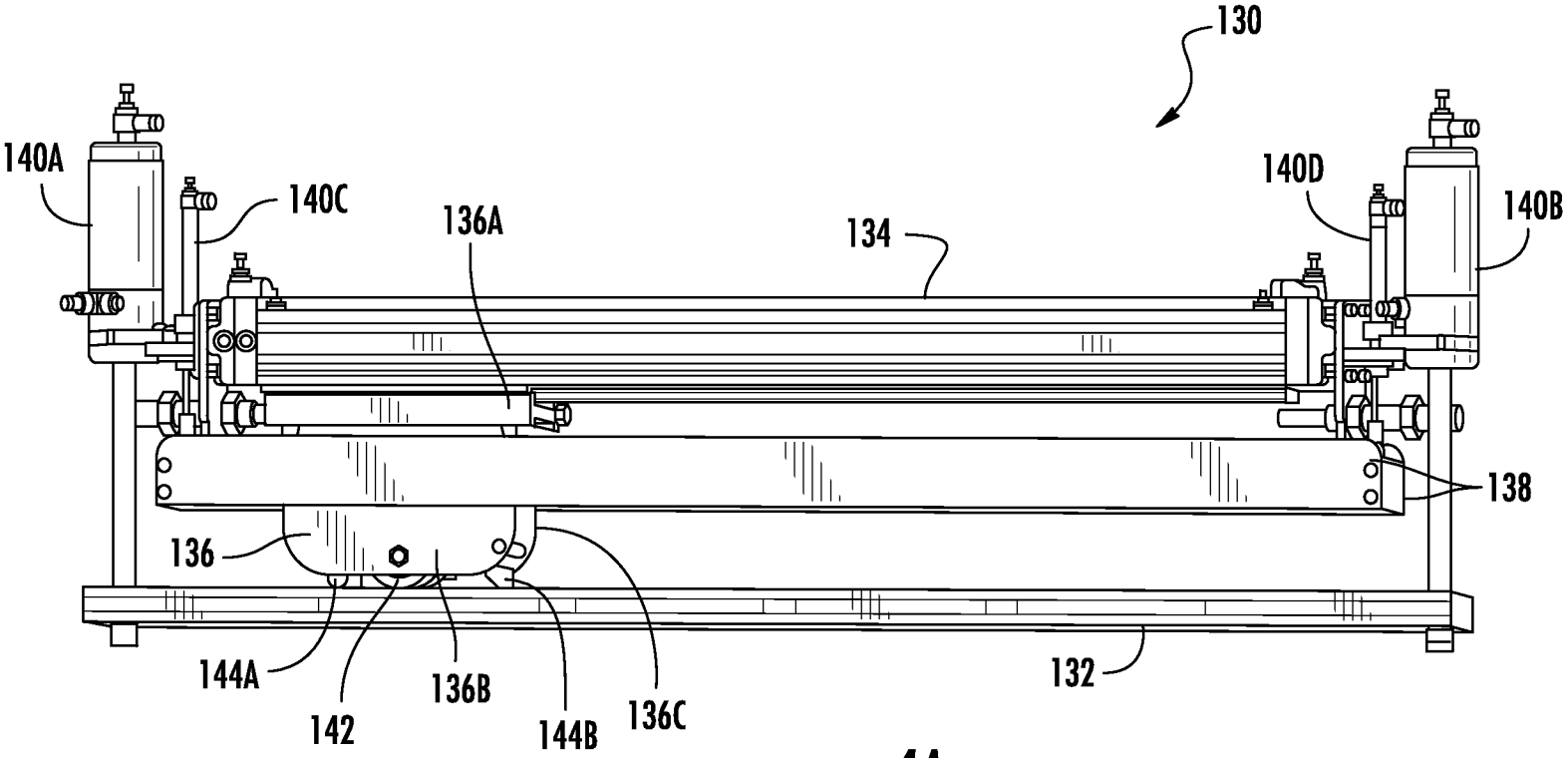
FIG. 4A illustrates a front view of an embodiment of a cross seal device that can be used in the embodiment of the package forming system according to the present subject matter.
Figure 4B:
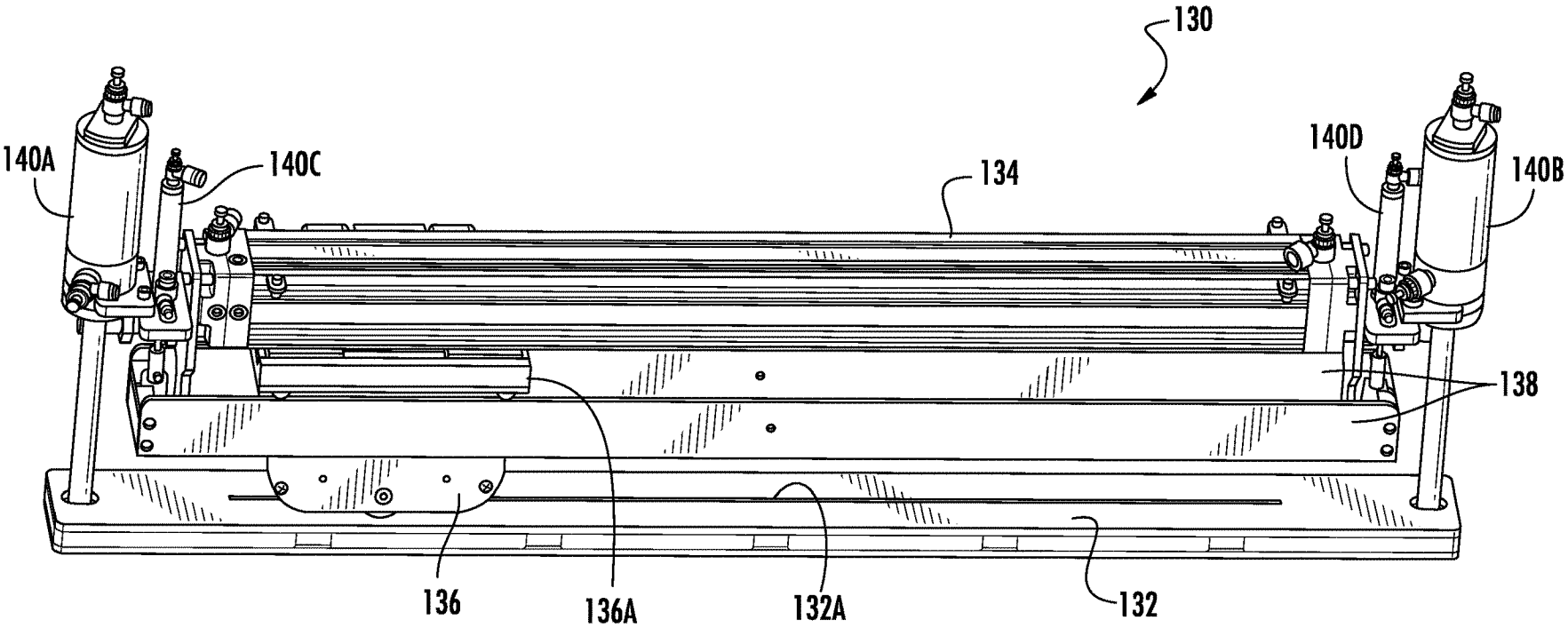
FIG. 4B illustrates a top perspective view of the embodiment of the cross seal device according to FIG. 4A.
Figure 4C:
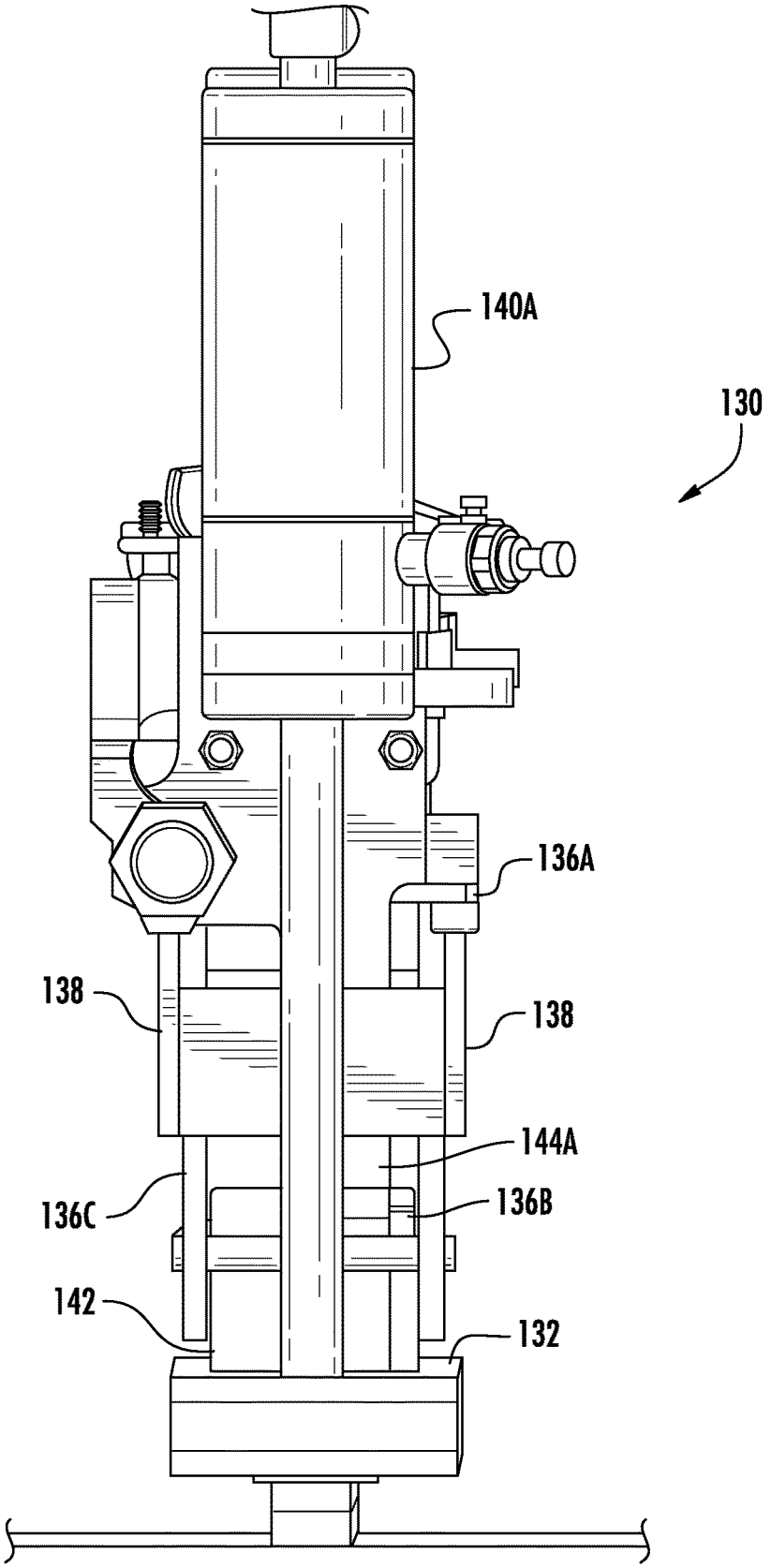
FIG. 4C illustrates a side perspective view of the embodiment of the cross seal device according to FIG. 4A.
Figure 4D:
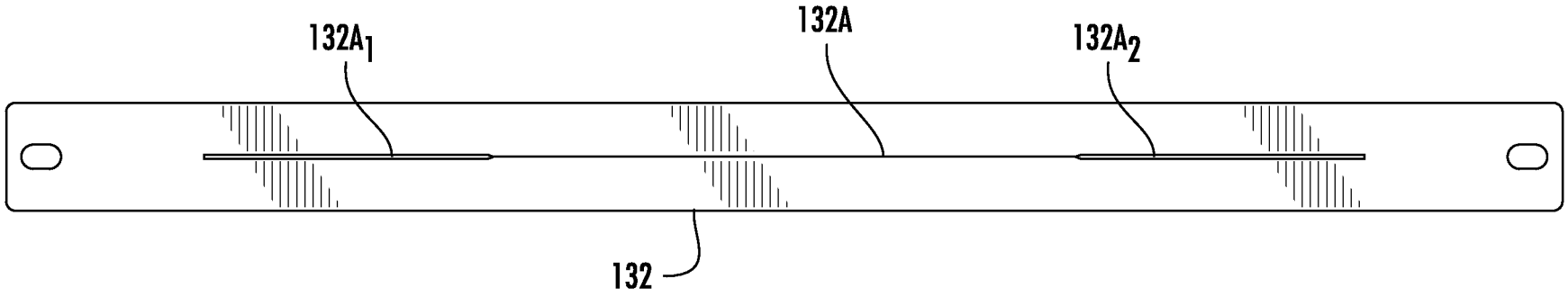
FIG. 4D illustrates a top plan view of an embodiment of an anvil plate that can be used in the embodiment of the cross seal device according to FIG. 4A.
Figure 4E:
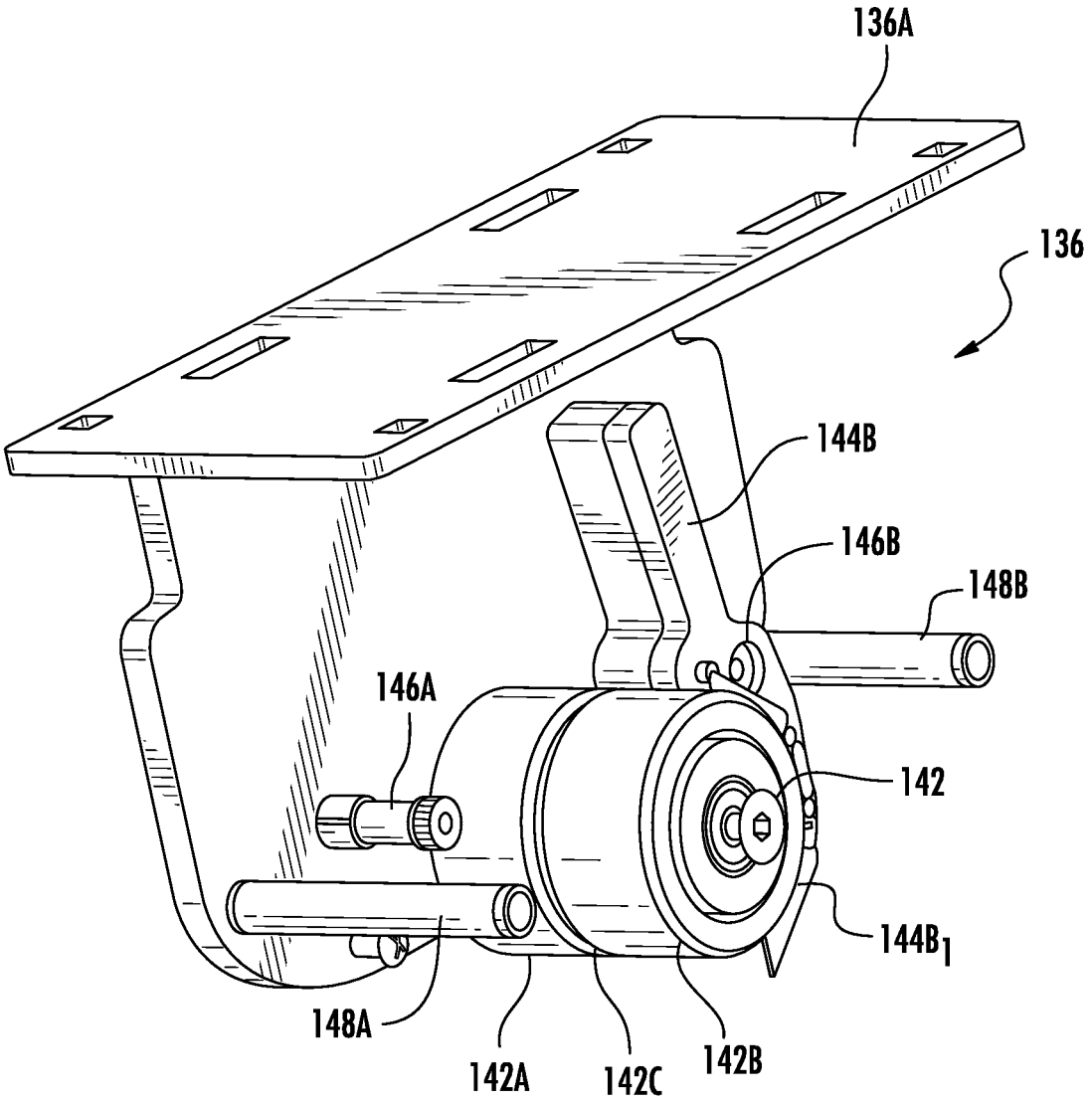
FIG. 4E illustrates a front side perspective view of an embodiment of a carriage that can be used in the embodiment of the cross seal device according to FIG. 4A.
Figure 4F:
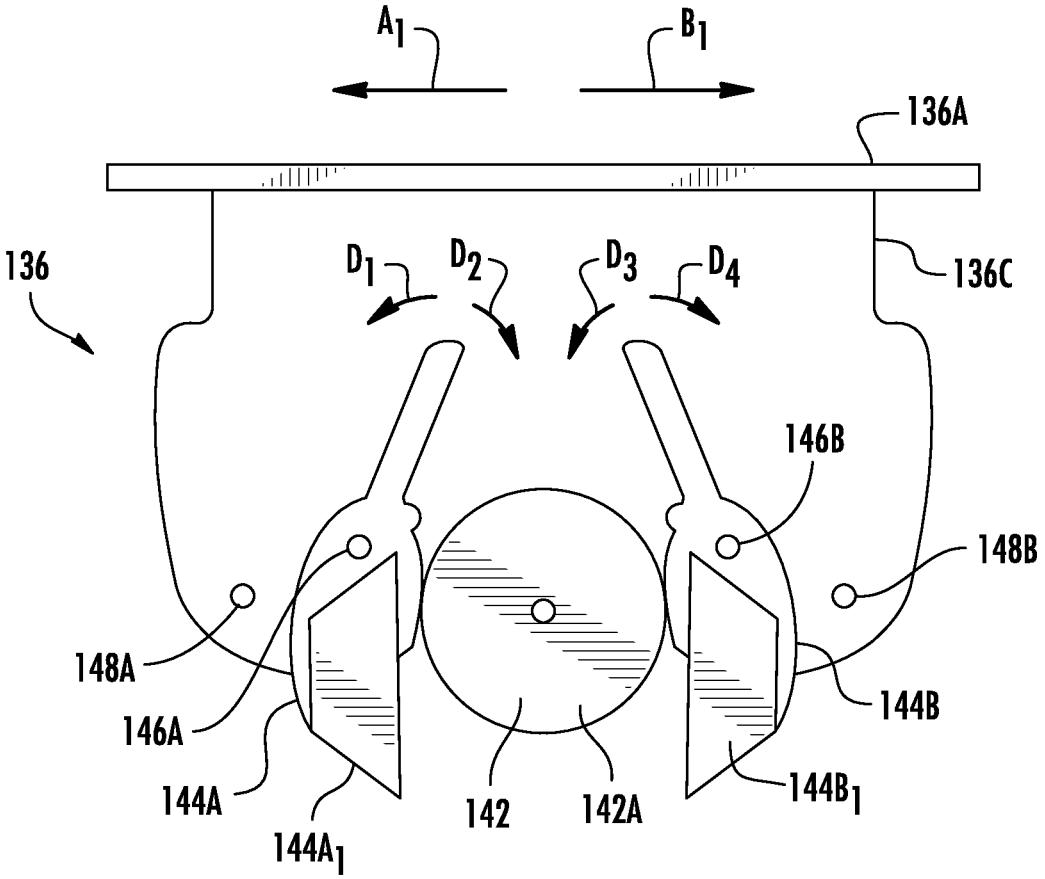
FIG. 4F illustrates a front plan view of the embodiment of the carriage according to FIG. 4E that can be used in the embodiment of the cross seal device according to FIG. 4A.
Figure 4G:
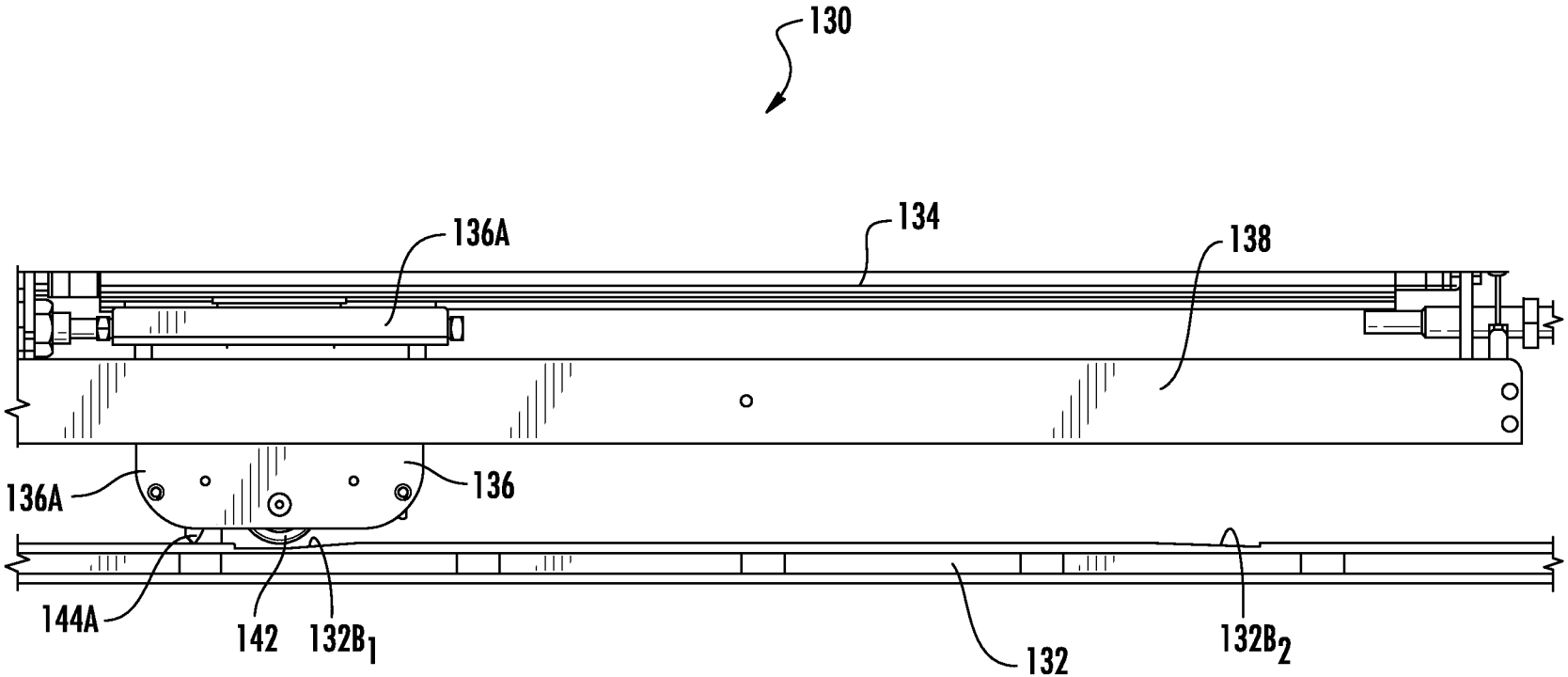
FIG. 4G illustrates a front view of a portion of the embodiment of the cross seal device according to FIG. 4A.
Figure 4H:
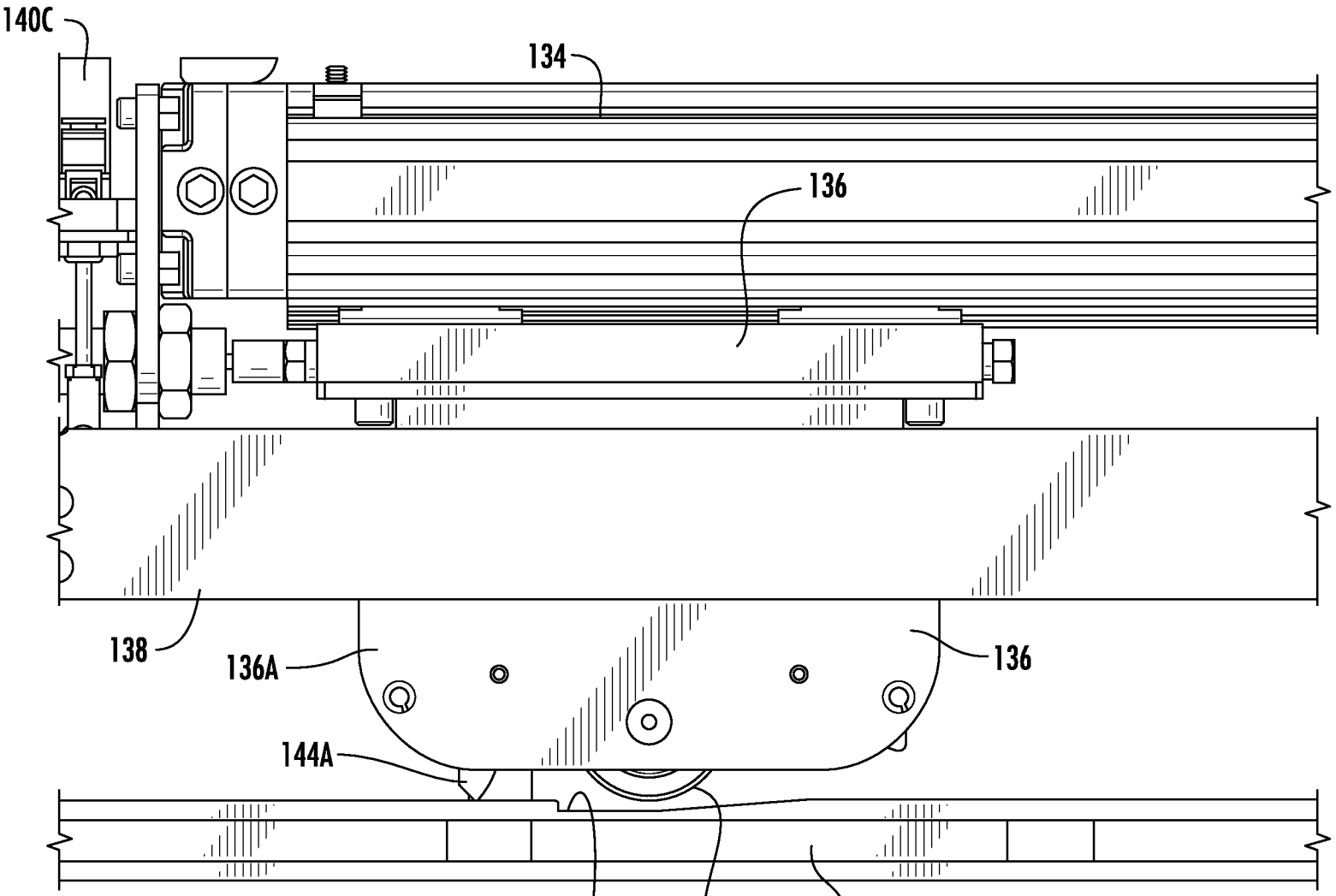
FIG. 4H illustrates a front view of a portion of the embodiment of the cross seal device according to FIG. 4A.
Figure 4I:
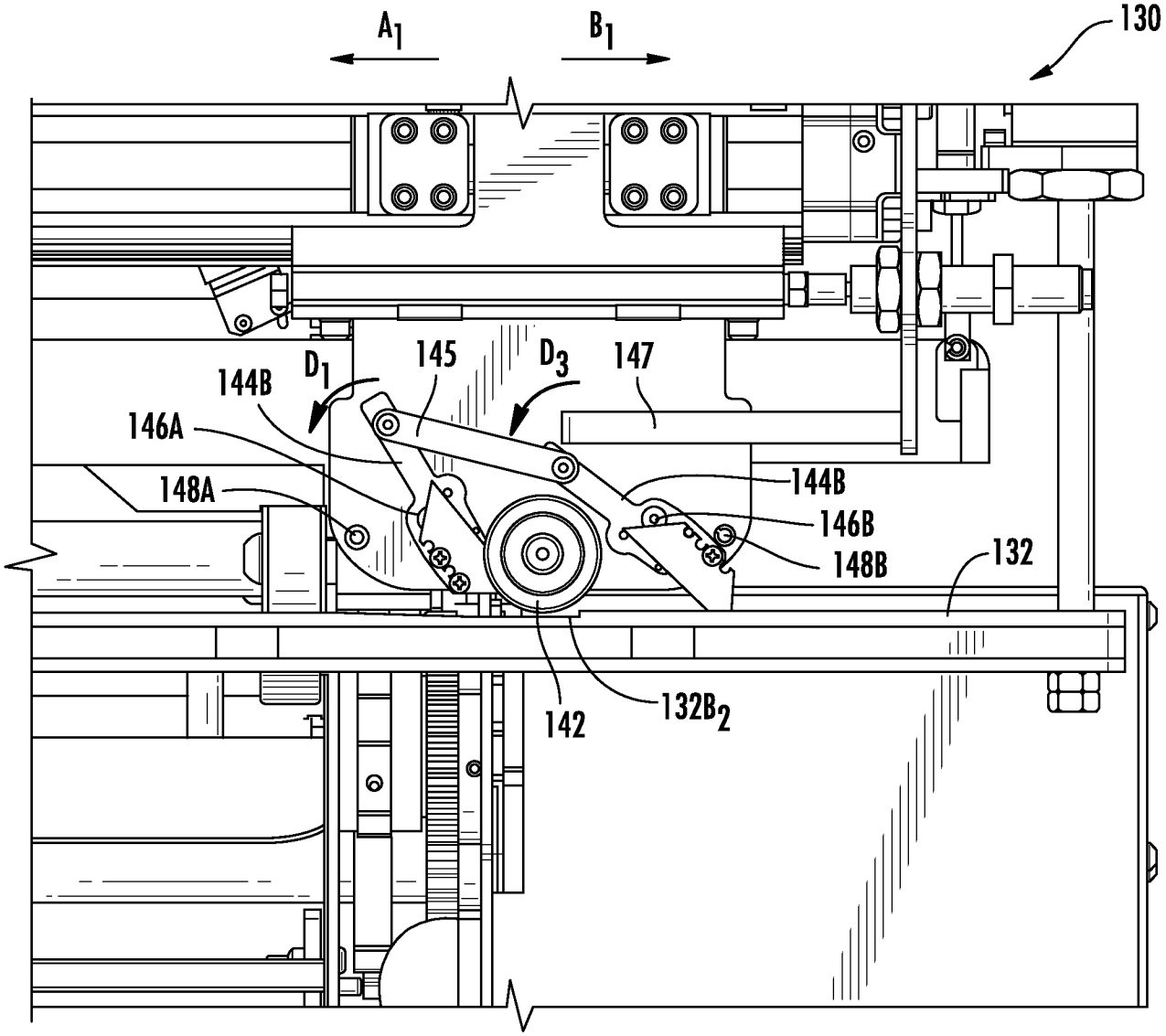
FIG. 4I illustrates a front view of a portion of the embodiment of another embodiment of a cross seal device according to the present subject matter that can be used in the embodiment of the package forming system according to FIG. 3A.

In some embodiments as shown in FIG. 4I, the carriage 136 can have a different arrangement for the first and second blades 144A, 144B. For example, the first and second blades 144A, 1448 can be secured to a swing bar, or link, 145 that connects the first and second blades 144A, 144B together and allows the first and second blades 144A, 144B to move in tandem as they are pushed to one side or the other by push bars, for example, push bar 147, located on either side of the cross seal device 130. As shown in FIG. 4I, when the carriage 136 moves in the direction $B_1$ into the resting position, the contact of the push bar 147 against the top portion of the respective second blade 144B as the carriage 136 moves toward a resting position on a second side of the pathway PA causes the second blade 144B to rotate around the pivot fulcrum 146B in a direction $D_3$ toward the second stops 148B and, at the same time, the swing, link 145 causes the first blade 144A to rotate in a direction $D_1$ upward out of the slot 132A of the anvil 132 toward the roller 142. Similarly, when the carriage 136 moves in the direction $A_1$ (see FIG. 4F as reference) into the resting position, the contact of the push bar (not shown) on the opposite side of the pathway PA against the top portion of the respective first blade 144A as the carriage 136 moves toward a resting position on a first side of the pathway PA causes the first blade 144A to rotate around the pivot fulcrum 146B in a direction $D_2$ (see FIG. 4F as reference) toward the first stop 148A and, at the same time, the swing link 146 causes the second blade 144B to rotate in a direction $D_4$ (see FIG. 4F as reference) upward out of the slot 132A of the anvil 132 toward the roller 142.

The use of the swing link 145 and push bars 147 can be useful in ensuring that the blade 144A, 144B that is to cut the top and bottom sheet materials TS, BS traveling in the pathway PA is, in the slot 132A of the anvil 132, while the other respective blade 144A, 144B that is not cutting the top and bottom sheet materials TS, BS is raised out of the slot 132A of the anvil 132. In embodiments of the cross seal device 130 that employ cam surfaces 132$B_1$ and 132$B_2$ on either side of the anvil 132 where the rollers 142 reside when the carriage 136 is at rest in a resting position on either side of the pathway PA as show in FIG. 4I, the use of the swing link 145 and push bars 147 can be useful. For example, the swing link 145 and push bars 147 can facilitate the movement of the respective blade 144A, 144B that is not cutting the top and bottom sheet materials TS, BS out of the slot 132A of the anvil 132 to a position that will not reenter the slot, when anvil 132 moves upward when the roller 142 of the carriage 136 enters the indention of the respective cam surface 132$B_1$ and 132$B_2$.

As stated above, the support table 110 of the package forming system 100 can be, used to support a portion of the bottom sheet material BS and the product that is placed upon the bottom sheet material BS and is being conveyed by the bottom sheet material BS. The support table 110 can include some of the guide system 104 of the bottom sheet material BS. The support table 110 can be automatically or semi-automatically adjusted upwardly or downwardly based on the centerline of the product being packaged to align the centerline of the product with the nips of the sets of rollers 108 as well as the nip created by the roller 142 and anvil 132 when the rollers are put under pressure. By having a small nip between the roller 142 and the anvil 132, a small surface area of contact between the roller 142 and the anvil 132 is created. Compared to the traditional technique of using a long sealing bar that is forced downward cross the pathway PA to seal the ends of the package, having a small surface area of contact between the roller 142 and the anvil 132, much greater pressure between the roller 142 and the anvil 132 can be created with less required force being applied to create such pressure. Thereby, with the greater pressure created between the roller 142 and the anvil 132, a stronger seal at the ends of the packages being formed can be created by the roller 142 and the anvil 132.

As shown in FIGS. 3A-3C and 5, the package forming system 100 can further comprise a controller 150 that can be used to control the operation of the package forming system 100 and the different systems, components, and devices that comprise the package forming system 100, including the adjustment of the adjustable table 110, cross seal device 130 and the nip rollers 108. In particular, in some embodiments, the controller 150 can be in communication with the cylinders 140A, 1408 and the carriage 136 to engage and control the operation of the cylinders 140A, 140B and the carriage 136 so that the cylinders 140A, 140B and the carriage 136 operate in the manner described above. For example, the controller 150 can engage the carriage to travel transversely across the product pathway PA along the track 134. Additionally, the controller 150 can engage the cylinders 140A, 140B to create the pressure contact between the anvil 132 and the roller 142 and to release that pressure contact as described above. Similarly, the controller 150 can be in communication with the cylinders 140C, 140D to raise and lower the safety bar 138. The controller 150 can also be in communication with the driver system (not shown) that can be used to adjust the support table 110 upwardly or downwardly. The controller 150 can comprise any capable processing unit, such as a programmable logic controller ("PLC"), a desktop computer, a laptop computer, a mini computer, or the like, including combinations thereof. The controller 150 can process the information provided the sensors mentioned above as well as other sensors and information that the controller 150 can use to effectively operate the package forming system 100.

Figure 5:
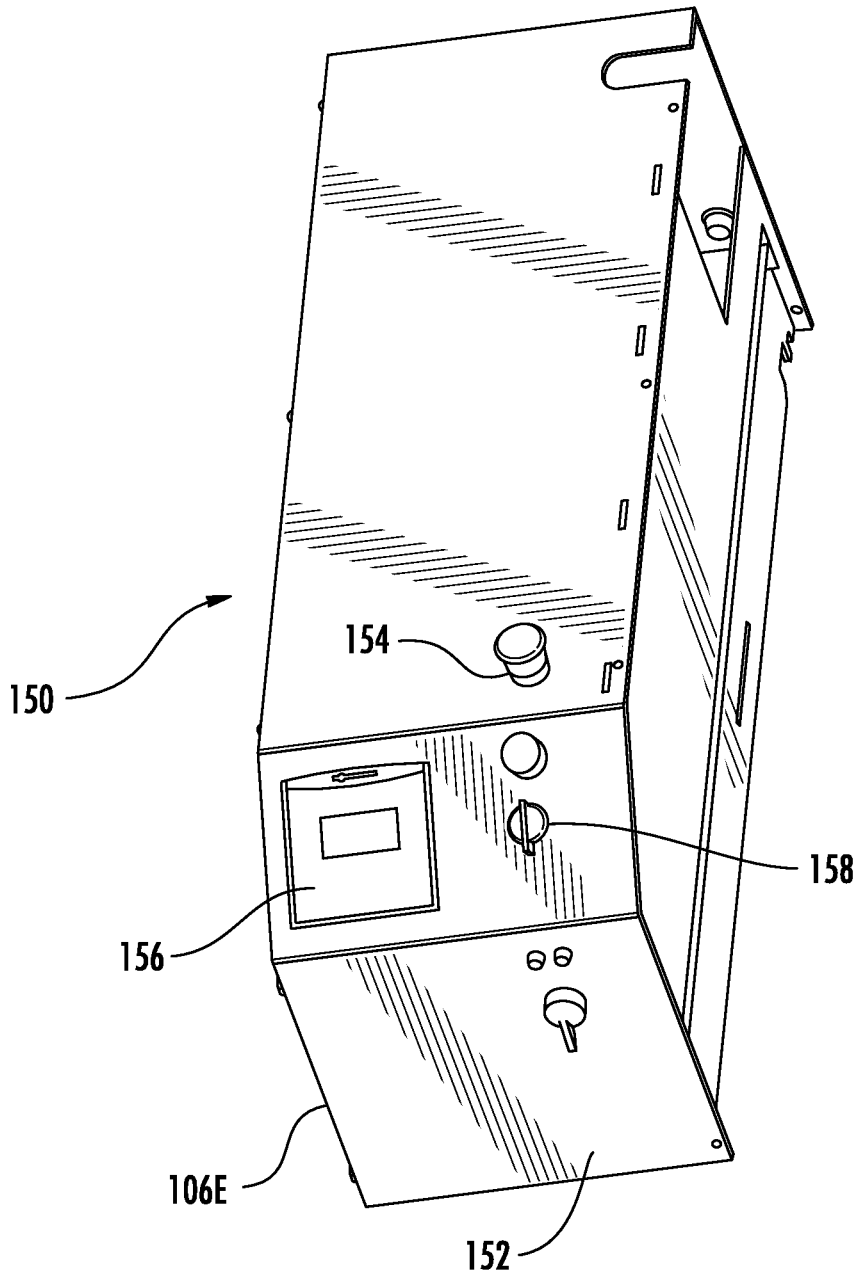
FIG. 5 illustrates a front perspective view of an embodiment of a controller that can be used in the embodiment of the package forming system according to FIG. 3A.

In some embodiments as shown in FIG. 5, the controller 150 can be encased by a housing 106E. The controller 150 can include an on-off switch 152 for turning on the package forming system 100 and an emergency stop, or E-stop button 154. The controller 150 can also include a display 156 that can be used to display pertinent information to operator as needed. The controller 150 can further include a switch 158 can be used to drive the bottom sheet materials TS, BS within the package forming system 100 by activating the nip rollers 108. The controller 150 can also comprise an operation button and can be pushed to advance the products being packaged within the package forming system 100 as certain criteria are met. For example, the operation button can be able to be lit green to indicate to the operator that the product can be advanced within package forming system 100.

As outlined above, the variety of cross seal devices disclosure herein can operate under a variety of different methods as outlined above. For example, a method for forming ends of packages being formed in a packaging forming system using a cross seal device, can be provided that includes various steps. For instance, the method can comprise providing a cross seal device that can comprise an anvil configured to extend transverse to a product pathway of a packaging forming system along which top and bottom sheet materials travel. The cross seal device can also comprise a track positioned above the anvil transverse to the product pathway and a carriage configured to operate along the track, the carriage comprising one or more rollers. Additionally, the method can comprise feeding a top sheet material and a bottom sheet material used to form a package around a product between the anvil of the cross seal device and the track. The method can also comprise engaging the anvil with the carriage to form a pressure contact between the anvil and the roller. Further, the method can comprise running the carriage along the track transverse to the product pathway so that the rollers under pressure against the anvil roll over the top and bottom sheet materials to join together the top and bottom sheet materials.

In some embodiments of the method, the step of engaging the anvil with the carriage can comprise moving the anvil toward and away from the track with one or more air cylinders to form the pressure contact between the anvil and the one or more rollers that seal the ends of the packages being formed. In some embodiments, the method can comprise cutting the joined top and bottom sheet materials with a blade attached to the carriage to form the ends of the respective adjacent packages being formed in the system. In some embodiments, the method can comprise extending the blade of the carriage into a blade slot in the anvil as the as the one or more rollers of the carriage run across the anvil and the blade cuts the joined top and bottom sheet materials. In some embodiments, the method can further comprise moving safety bars downward around the carriage and against the anvil to, block access to the carriage when the one or more rollers of the carriage engage the anvil. In such embodiments, the method can comprise detecting with sensors if either end of the safety bars is completely lowered so that only the top and bottom sheet materials are between the safety bars and the anvil.

The cross cut-seal cylinder can be equipped with two vertical air cylinders in addition to a cross rod-less cylinder. The two vertical cylinders can raise and lower the cross cut-seal cylinder in different manners. For example, one vertical cylinder can raise the seal anvil up and down. The other vertical cylinder can raise and lower a safety bar to be sure that there is nothing in the way of the cross cylinder. This cylinder can have a switch that is made if the safety bar is completely down on both ends of the seal bar. The cross rod-less cylinder has switches on both ends of its stroke and can be operated by a double solenoid air valve.

The cross cut/seal routine can operate as follows. The PLC can look at both the left and right end of stroke of the rod-less cylinder to see where the carriage of the cylinder is parked. The seal anvil can be raised and the safety bar can be lowered. The solenoid can be energized to move the cut/seal carriage away from the end where it is parked if both sides of the safety bar are down. If both ends are not down, the system can stop and can notify the operator via an operator panel. The solenoid can remain on until the end of stroke switch on the opposite of the rod-less cylinder closes. This solenoid can then be turned off and the safety bar can be raised with the seal anvil being lowered.

These and other modifications and variations to the present subject matter may be practiced by those of ordinary skill in the art, without departing from the spirit and scope of the present subject matter, which is more particularly set forth herein above and any appending claims. In addition, it should be understood the aspects of the various embodiments may be interchanged either in whole or in part. Furthermore, those of ordinary skill in the art will appreciate that the foregoing description is by way of example only, and is not intended to limit the present subject matter.

What is claimed is:

1. A cross seal device for forming ends of packages being formed in a packaging forming system, the cross seal device comprising:

an anvil configured to extend transverse to a product pathway of a packaging forming system along which top and bottom sheet materials travel;

a track positioned above the anvil transverse to the product pathway; and a carriage configured to operate along the track, the carriage comprising:

one or more rollers configured to engage the anvil as the carriage moves transversely across the product pathway to form a pressure contact between the anvil and the one or more rollers so that the top and bottom sheet materials are joined together to form a transverse cross seal;

a first blade and a second blade that move transversely across the product pathway from one side of the product pathway to an opposing side of the product pathway with the carriage to cut the joined top and bottom sheet materials to form the ends of the respective adjacent packages being formed in the system; and a swing bar that connects the first and second blades together and allows the first and second blades to move in tandem as they are pushed to one side or the other by push bars secured on either end of the track.

2. The cross seal device according to claim 1, wherein the carriage comprises a top wall and first and second carriage walls, the carriage top wall comprising rails that engage the track.

3. The cross seal device according to claim 1, wherein the anvil comprises a blade slot therein in which the first and second blades run once the roller carriage engages the anvil and the carriage runs across the anvil.

4. The cross seal device according to claim 3, wherein the blade slot comprises a singular width.

5. The cross seal device according to claim 3, wherein the blade slot comprises a wider width on ends of the blade slot where the first and second blades rotate and a more narrow width in a middle portion of the blade slot where the cutting of the sheet materials occurs.

6. The cross seal device according to claim 1, further comprising safety bars that are configured to move downward around the carriage to the anvil to block access to the carriage when the one or more rollers engages the anvil.

7. The cross seal device according to claim 6, wherein the safety bars comprise sensors configured to detect if either end of the safety bars is completely lowered so that only the top and bottom sheet materials are between the safety bars and the anvil.

8. The cross seal device according to claim 1, wherein the one or more rollers are held within the carriage by an axle that allows for rotation of the one or more rollers.

9. The cross seal device according to claim 1, wherein the one or more rollers comprises a roller with a groove around a circumference of the one or more rollers.

10. The cross seal device according to claim 1, further comprising one or more pressure application devices to form the pressure contact between the anvil and the one or more rollers that seal the ends of the packages being formed.

11. The cross seal device according to claim 10, wherein the one or more pressure application devices comprise air cylinders that are configured to move the anvil toward and away from the track.

12. A cross seal device for forming ends of packages being formed in a packaging forming system, the cross seal device comprising:

an anvil configured to extend transverse to a product pathway of a packaging forming system along which top and bottom sheet materials travel;

a track positioned above the anvil transverse to the product pathway; and a carriage configured to operate along the track, the carriage comprising one or more rollers configured to engage the anvil as the carriage moves transversely across the product pathway to form a pressure contact between the anvil and the one or more rollers so that the top and bottom sheet materials are joined together to form a transverse cross seal across the product; and the anvil comprising cam surfaces on either side of the anvil where the one or more rollers reside when the carriage is at rest on either side of the product pathway.

13. The cross seal device according to claim 12, wherein the cam surfaces comprise slight indentions in the anvil.

14. The cross seal device according to claim 13, further comprising safety bars that are configured to move downward around the carriage to the anvil to block access to the carriage when the one or more rollers engages the anvil.

15. The cross seal device according to claim 14, wherein the depth of the indentions is such that the anvil is about parallel with the safety bars when the safety bars are in a down contact position so that a contact switch is made.

16. The cross seal device according to claim 15, wherein, once the contact switch is made, the carriage is activated to move in the proper transverse direction to the pathway to form the ends of the respective packages with the rollers riding up the respective cam surface.

17. The cross seal device according to claim 16, wherein the carriage holds its position relative to the track as the carriage travels along the track such that the roller pushes the anvil downward as the roller moves out from the respective cam surfaces and along the top of the anvil.

18. The cross seal device according to claim 12, wherein the carriage comprises a first blade and a second blade configured to cut the joined top and bottom sheet materials to form the ends of the respective adjacent packages being formed and the carriage comprises a swing bar that connects the first and second blades together and allows the first and second blades to move in tandem as they are pushed to one side or the other by push bars secured on either end of the track.

19. The cross seal device according to claim 12, wherein the anvil comprises a blade slot therein in which one or more blades on the carriage run once the carriage engages the anvil and the carriage runs across the anvil.

20. The cross seal device according to claim 19, wherein the blade slot comprises a wider width on ends of the blade slot where the one or more blades rotate and a more narrow width in a middle portion of the blade slot where the cutting of the sheet materials occurs.

* * * * *